US007381281B2

(12) United States Patent
Maeda et al.

(10) Patent No.: US 7,381,281 B2
(45) Date of Patent: Jun. 3, 2008

(54) SURFACE TREATMENT METHOD OF METAL MEMBER, AND METAL GOODS

(75) Inventors: Akio Maeda, Yamaguchi (JP); Seiji Kuge, Yamaguchi (JP)

(73) Assignee: Chiyoda Chemical Co., Ltd, Kumage-gun (JP)

( * ) Notice: Subject to any disclaimer, the term of this patent is extended or adjusted under 35 U.S.C. 154(b) by 475 days.

(21) Appl. No.: 10/294,646

(22) Filed: Nov. 15, 2002

(65) Prior Publication Data

US 2003/0226621 A1 Dec. 11, 2003

(30) Foreign Application Priority Data

Nov. 21, 2001 (JP) ..... 2001-355492

(51) Int. Cl.
*C23C 22/60* (2006.01)

(52) U.S. Cl. ..... 148/243; 148/253; 148/261; 148/262; 428/472.3

(58) Field of Classification Search ..... 148/240, 148/243, 21, 253, 261–262; 428/472.3
See application file for complete search history.

(56) References Cited

U.S. PATENT DOCUMENTS 3,756,864 A 9/1973 Zaccagnini
3,767,476 A 10/1973 Wagner et al.
3,852,125 A * 12/1974 Brown ..... 428/471
4,148,670 A * 4/1979 Kelly ..... 148/247
4,711,667 A 12/1987 Bibber
4,778,533 A * 10/1988 Gregory et al. ..... 134/29
5,462,634 A * 10/1995 Kamiyama et al. ..... 216/85
5,645,650 A * 7/1997 Ishizaki et al. ..... 148/260
5,900,074 A * 5/1999 Ishizaki et al. ..... 148/260
6,214,132 B1 * 4/2001 Nakayama et al. ..... 148/254
6,409,844 B1 * 6/2002 Shikata et al. ..... 148/261
6,551,417 B1 * 4/2003 Rodzewich et al. ..... 148/250
6,692,583 B2 * 2/2004 Bengston et al. ..... 148/261
6,733,896 B2 * 5/2004 Dolan et al. ..... 428/472
6,736,908 B2 * 5/2004 Sako et al. ..... 148/25
2003/0213771 A1 * 11/2003 Ohshita et al. ..... 216/83

FOREIGN PATENT DOCUMENTS

CN 1302341 7/2001

(Continued)

OTHER PUBLICATIONS

"Journal of Materials Protection"; Monthly, Started in 1960; ISSN 1001-1560, Oct. 2001; vol. 34 No. 10 Serial No. 273.

*Primary Examiner*—Harry D. Wilkins, III
*Assistant Examiner*—Nicholas A. Smith
(74) *Attorney, Agent, or Firm*—Oblon, Spivak, McClelland, Maier & Neustadt, P.C.

(57) ABSTRACT

A method of surface-treating a metal member involves heating, or heating under pressure, the metal member in an aqueous alkaline solution having a pH of 9 or more and containing a manganese compound and a chelating agent dissolved in water, whereby a mold release agent or dirt is removed from the metal member without any pre-cleaning process. The surface treatment forms on the metal member a surface treatment layer providing excellent corrosion resistance. Paint, which adheres well to the surface treatment layer, can provide additional corrosion protection.

15 Claims, 1 Drawing Sheet

FOREIGN PATENT DOCUMENTS

| | | |
|---|---|---|
| DE | 692 311 | 6/1940 |
| EP | 0 209 143 | 1/1987 |
| GB | 533 841 | 2/1941 |
| GB | 1 042 108 | 9/1966 |
| JP | 48-36037 | 5/1973 |
| JP | 50-44134 | 4/1975 |
| JP | 62-20880 | 1/1987 |
| JP | 63-62885 | 3/1988 |
| JP | 2-183778 | 7/1990 |
| JP | 8-35073 | 2/1996 |
| JP | 2000-199074 | 7/2000 |
| JP | 2002-322567 | 11/2002 |

* cited by examiner

SURFACE TREATMENT METHOD OF METAL MEMBER, AND METAL GOODS

BACKGROUND OF THE INVENTION

1. Field of the Invention

The present invention relates to a surface treatment method for surface-treating a metal member molded by casting or expanding metal, to thereby produce a uniform surface at a lower cost; to metal goods that are surface-treated to form thereon an anticorrosive surface treatment coating; and to metal goods wherein a corrosion-resistant paint film is formed on that surface treatment coating by the application of corrosion-resistant paint thereon.

2. Discussion of the Background

Many metals are susceptible to corrosion at high temperature and humidity, particularly in a salt-contained atmosphere, if not coated with paint. When coated with paint, a molded metal member must be subjected to a pre-cleaning process to clean a mold release agent, commonly used for molding the metal, remaining on a surface of the molded metal member. If the molded metal member is coated with paint without being subjected to the pre-cleaning, the adhesion of the paint film to the metal member will be significantly reduced, triggering early corrosion.

Especially for a molded metal member having crimples and cracks on its surface, the mold release agent intrudes in between the crimps and cracks, so that the mold release agent remains therein easily even when the molded metal member is subjected to the pre-cleaning process.

To address these problems, the following three processes are commonly used. First, (a) a pre-cleaning process using alkali degreasing, acid pickling or blast polishing is performed to clean the surface of the metal member. Then, (b) a base coat process is performed to subject the surface of the metal member to a chemical conversion treatment using chromate and the like. Thereafter, (c) a paint application process is performed to apply a corrosion-resistant paint to the surface of the treated metal member.

However, in (a), the blast polishing of the pre-cleaning process has the disadvantage that it is difficult to clean deep concaves of a molded product having a complicated shape, and the pre-cleaning process using alkali degreasing or acid pickling has the disadvantage of causing corrosion easily when contacted with remaining water. In (b), the chromate treatment has the disadvantage of producing ill effects on the human body. In (c), the paint application process has the disadvantage of failing to protect against corrosion during the time between the base coat process and the paint application process. Effective alternative chemical conversion treatments have not yet been proposed.

In recent years, various metal materials, including lightweight alloy materials typified by magnesium alloy, have been used as environmentally suitable materials to produce molded products in many fields. Many of the molded products have a complicated shape and are covered with a protective corrosion-resistant outer layer. However, because existing surface treatment methods do not provide the outer layer with satisfactory adhesion, the molded products do not have satisfactory corrosion resistance. Development of a novel surface treatment method that is suitable for these metal members and that can also provide an excellent corrosion proof coating and development of a novel corrosion-resistant agent suitably used in the method are now being awaited. The creation of such a novel surface treatment method and the corrosion-resistant agent could provide the metal members with expanded applications.

The present inventors have previously proposed a surface treatment method in which a cast product is surface treated by heating under pressure in a liquid (Japanese Patent Application No. 2001-126623). This method can eliminate the need for the pre-cleaning process; enables even a cast product having a complicated form to be properly surface-treated; and besides can make the surface-treated surface uniform, thus producing a cast product having good corrosion resistance.

However, when an acid surface-treatment liquid is used, a molded metal product, including a cast product, can sometimes be corroded by the acid, depending on the kind of metal member and the kind of acid. This corrosion can cause a reduction in dimensions and pitting corrosion to produce a non-uniform surface. On the other hand, when an alkaline compound is added to the surface-treatment liquid, in order to try to prevent these problems, the compound is precipitated to deteriorate the surface treatment liquid, producing the problem that the surface treatment coating cannot be formed stably.

SUMMARY OF THE INVENTION

The present invention aims to solve these problems. It is a primary object of the present invention to provide an effective surface treatment method, alternative to a pre-cleaning process of a metal member, such as cleaning, and a base coat process of the same, for stably producing a uniform surface treatment coating at a lower cost without giving ill effects on the human body as well as without any possible dimensional change and non-uniform surface resulting from corrosion, irrespective of the kinds of metal member. It is a secondary object of the present invention to provide a metal product having a surface treatment coating or a composite corrosion-resistant coating having excellent corrosion resistance.

For accomplishing the primary object mentioned above, the present invention provides a surface treatment method for surface-treating a metal member by heating the metal member in a liquid or by heating the metal member under pressure in the liquid, wherein the liquid is an aqueous alkaline solution wherein at least a manganese compound and a chelating agent are dissolved in water and whose pH value is adjusted to 9 or more, and wherein a heating temperature is 35° C. or more and the time for the metal member to be heated or heated under pressure is one minute or more.

According to the present invention, since the surface treatment liquid is an aqueous solution wherein at least a manganese compound and a chelating agent are dissolved in water and which is heated, or heated under pressure, at not less than 35° C. for not less than one minute, the surface of the metal member is cleaned and also an excellent surface treatment coating is produced stably. In addition, since the surface treatment liquid is an aqueous alkaline solution whose pH is adjusted to 9 or more by adjusting an amount of chelating agent added, there is no fear of possible dimensional change, pitting corrosion and rough surface resulting from corrosion by acid, irrespective of the kinds of metal member.

It is preferable that the surface treatment liquid is an aqueous solution wherein, in addition to the manganese compound and the chelating agent, a silicate or a molybdenum compound is dissolved in the water and the pH is adjusted to 9 or more. This can produce further improved corrosion resistance and also can facilitate the adjustment of the pH of the solution to 9 or more.

For accomplishing the secondary object mentioned above, the present invention provides metal goods wherein a surface treatment coating is formed on a metal member comprising at least one material selected from the group consisting of magnesium, magnesium alloy, aluminum, aluminum alloy, iron, iron alloy, copper, copper alloy, zinc, zinc alloy, tin and tin alloy, wherein the surface treatment coating comprises reaction product of a metal of the metal goods and a surface treatment liquid under heating or under heating under pressure, and wherein the surface treatment liquid is an aqueous alkaline solution wherein at least a manganese compound and a chelating agent are dissolved in water and whose pH value is adjusted to 9 or more.

According to this invention, since the surface treatment coating includes reduction product of a metal of the metal goods and a surface treatment liquid under heating or under heating under pressure, the surface treatment coating has corrosion resistance in itself. When a corrosion-resistant paint film is formed on that surface treatment coating, improved adhesion of that paint film to the surface treatment coating is provided. Besides, since the surface treatment coating is formed by an aqueous alkaline solution as the surface treatment liquid whose pH value is adjusted to 9 or more, no dimensional reduction resulting from the corrosion by acid is produced, thus providing high dimensional accuracy.

It is preferable that the surface treatment liquid is an aqueous solution wherein, in addition to the manganese compound and the chelating agent, either a silicate or a molybdenum compound is dissolved in water. This can further improve the corrosion resistance of the surface treatment coating. Also, it is preferable that a corrosion-resistant paint, wherein resin is dissolved in organic solvent or water, is applied to the surface treatment coating and then cured to form a paint film thereon. This can provide improved adhesion of the surface treatment coating to the corrosion-resistant paint film or layer formed thereon, and as such can produce a composite corrosion-resistant film having significantly excellent corrosion resistance. Further, it is preferable that the metal member comprises magnesium or a magnesium alloy. This can provide the advantage that although such a metal member is initially susceptible to corrosion by acid, it undergoes essentially no dimensional reduction resulting from corrosion, and results in a surface treatment coating or composite corrosion-resistant film having excellent corrosion resistance. Besides, since such a metal member is lightweight, metal goods that can be worked easily are obtained.

BRIEF DESCRIPTION OF THE DRAWINGS

FIG. 1(*b*) shows the cast metal member after undergoing the surface treatment.

FIG. 1(*c*) shows the surface-treated cast metal member after being coated with a paint film.

DETAILED DESCRIPTION OF PREFERRED EMBODIMENTS

In the following, certain preferred embodiments of the present invention will be described with reference to FIGS. 1(*a*), 1(*b*) and 1(*c*).

First, a surface treatment method for a cast product will be described.

Figure 1:
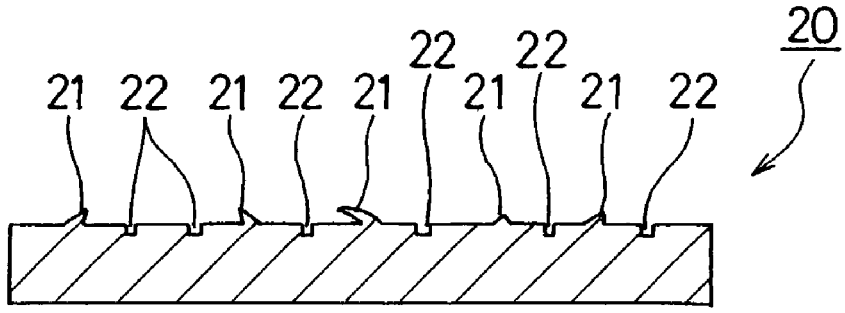
FIG. 1(*a*) shows cast metal member before a surface treatment.
Figure 1:
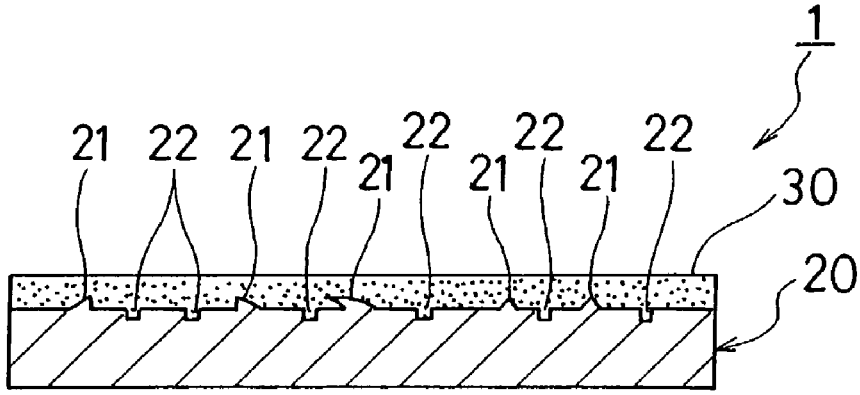
Figure 1:
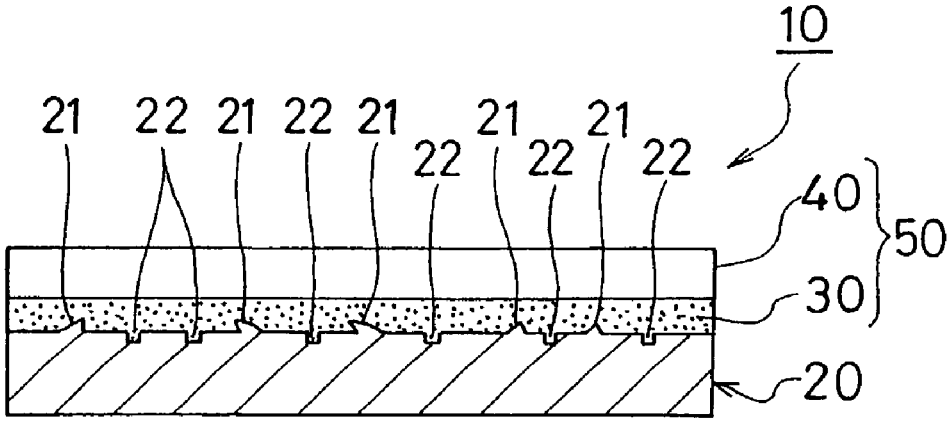

FIG. 1(*a*) shows a cast product 20 with some irregularities left on the surface, including small bumps 21, such as burrs and crimps, and dips 22, such as fine pores and cracks, in addition to the designed concavity and convexity of the cast product. Also, some residuals of a mold release agent are adhesively left on the surface of the cast product 20 at portions thereof shadowed by the bumps 21 and in the interior of the dips 22, though not shown.

FIG. 1(*b*) shows cast goods 1 having a surface treatment coating 30 formed on the cast product 20.

FIG. 1(*c*) shows cast goods 10 having a corrosion-resistant paint film 40 formed on the surface treatment coating 30 of the cast goods 1 by the application of the corrosion-resistant paint thereon.

According to a surface treatment method for a metal member of the present invention, the cast product 20 is dipped in a liquid filled in a container, such as an autoclave, and is heated or hot-pressed (heated under pressure) to melt or soften extraneous matter, such as the residuals of the mold release agent, whereby the extraneous matter is cleanly removed not only from the surface of the cast product 20 at portions thereof shadowed by the bumps 21 but also from the interior of the dips 22. In addition, making adequate choice of the liquid enables the surface treatment coating to be formed between the metal of the cast product and the liquid to cover over the surface of the cast product uniformly. This can shorten the conventional two-stage surface treatment processes, comprising the pre-cleaning process and the base coat process (chemical conversion treatment), to a simplified single-state surface treatment process. This can produce the surface treatment coating at a lower cost and also can clear up the anxiety of giving ill effects on the human body.

The liquid used for the surface treatment (surface treatment liquid) is ① an aqueous alkaline solution wherein a manganese compound and a chelating agent are dissolved in water and whose pH is adjusted to 9 or more or ② an aqueous alkaline solution wherein a manganese compound, a chelating agent, and either or both of a silicate and a molybdenum compound are dissolved in water and whose pH is adjusted to 9 or more.

In both aqueous solutions of ① and ②, the manganese compound reacts with the chelating agent to form a stable aqueous solution. The metal of the metal member dipped in that stable aqueous solution reacts with the complex manganese compound to form a surface treatment coating having excellent corrosion resistance. Besides, since the pH value of the stable aqueous solution is adjusted to 9 or more, there is no fear of possible reduction of dimension and non-uniform surface resulting from corrosion.

In the aqueous solution of ②, when the silicate and/or molybdenum compound are/is additionally dissolved in water, the ease with which the pH value of the aqueous solution is adjusted to 9 or more is increased, and also the corrosion resistance of the surface treatment coating including the reaction product of the metal of the cast product and the surface treatment liquid is further improved.

The manganese compounds that may be used include compounds of phosphoric acid, sulfuric acid, carbonic acid, boric acid and acetic acid, and salt and the like, such as manganese dihydrogen phosphate and manganous sulfate.

The chelating agents that may be used include compounds of metal salt, ammonium salt and amine salt of ethylenediaminetetraacetic acid, hydroxyethyl ethylenediaminetriacetic acid, nitrilotriacetic acid, diethylenetriaminepentaacetic acid, triethylenetetraminehexaacetic acid, hydroxyethyliminodiacetic acid, 1,3-propanediaminetetraacetic acid, 1,3-diamino-2-hydroxypropane tetraacetic acid, dicarboxymethylglutamic acid, dihydroxyethylglycine, hydroxyethylidenephosphonic acid, nitrilotrismethylenephosphonic acid, phosphonobutanetricarboxylic acid, polyacrylic acid, and acrylate•maleate copolymer.

The silicates that may be used include compounds of alkali metal salt, ammonium salt and amine salt of methasilicic acid, orthosilicic acid, disilicic acid and tetrasilicic acid.

Preferably, the aqueous solution contains the manganese compound in an amount of not more than 10%, or preferably not more than 5%; the chelating agent in an amount of not more than 15%, or preferably not more than 10%; and the silicate in an amount of not more than 15%, or preferably not more than 10% (it is to be noted that % indicates weight %, unless otherwise specified: the same applied to the following). Although the material contained in the aqueous solution may have a concentration in excess of the concentration range cited above, the effects are then saturated and no economical advantages are provided. On the contrary, if the material contained in the aqueous solution exceeds the upper limits, residuals of the surface treatment liquid will then adhere to the surface of the surface-treated cast products, to cause poor adhesion to the paint.

The conditions for the heating or the heating under pressure depend upon a solidification point and a boiling point of the surface treatment liquid used, due to which the conditions cannot be specified principally. In general, the heating or the heating under pressure is performed under the conditions of the heating temperature in the range of 35-250° C., or preferably 60-180° C.; the atmospheric pressure in the range of 0-20 kgf/cm$^2$, or preferably 0-10 kgf/cm$^2$; and the treatment time in the range of 1-300 minutes, or preferably 5-120 minutes. Those conditions are subject to change, depending on the kinds of the cast product, however.

When the treatment temperature is below the range cited above, the reaction rate is reduced, such that the intended surface is not obtained. The cast product may be heated at a temperature in excess of 250° C., but deterioration may progress depending on the kinds of the surface treatment liquid, so that it is not advantageous economically.

Concerning the pressurization, the atmospheric pressure may be set to be in excess of 20 kgf/cm$^2$, but the effects of the high-pressure treatment are then saturated. When the treatment time is in excess of 120 minutes, the same tendency develops and the effects on the industrial cost are substantially provided. Accordingly, these conditions out of the ranges specified above are undesirable. Also, under such conditions, metal material sometimes changes in dimensions.

The surface treatment liquid is not limited to the one cited above. The surface treatment liquid may be properly selected, in consideration of bonding strength and convenience in handling. The means for heating or heating under pressure is not limited to the autoclave, as long as it belongs to the category or the range mentioned above.

While in the embodiment illustrated above, the cast product is cited as the metal member, the metal molding methods that may be used include not only the casting method but also the expanding method. In addition, any material well suited to the method used may be selected.

The metals of the metal member the present invention is intended for include iron, copper, aluminum, magnesium, zinc, tin, and alloys based on those metals.

As for the metals susceptible to corrosion by acid, such as magnesium and alloys thereof, there is the possibility that they may be reduced in dimension due to the corrosion by acid. According to the surface treatment method of the present invention, the surface treatment coating having corrosion resistance can be formed without any fear of such reduction of dimension.

In the metal goods 1 shown in FIG. 1(*b*) thus obtained, the surface of the metal member 20 is cleanly washed and also is bonded to the surface treatment liquid at high bonding strength. This can produce the result that the surface treatment coating 30 is formed over the surface of the metal member 20 at portions thereof shadowed by the bumps 21 as well as in the interior of the dips 22, and as such can allow the coating to be uniform. In addition, the surface treatment coating 30 gives no ill effects on the human body. Besides, the surface treatment coating 30 has the corrosion-resistant property in itself and also has the good adhesion to a corrosion-resistant paint film as mentioned later.

Second, the painting process for forming the corrosion-resistant paint film shown in FIG. 1(*c*) on the metal goods 1 will be described.

At least one kind of paint, wherein one or more resin is dissolved in organic solvent or water, is used as the corrosion-resistant paint.

The resin materials that may be used include epoxy resin, urethane resin, phenol resin, polyolefin resin, silicon resin, alkyd resin, acrylic resin, fluorocarbon resin and melamine resin.

Any organic solvent may be used, as long as it can form a coating film on the cast product by drying at room temperature, by heat treatment or by using a curing agent after the paint application.

The coating paint application methods that may be used include, for example, dip method, spray method, brush application, electrostatic coating and electrodeposition coating, though no particular limitation is imposed to the coating paint application methods.

The corrosion-resistant layer formed on the surface of the metal member by the coating paint application is cured, for example, by air drying, heat treatment, electron irradiation, UV irradiation or addition of curing agent.

The conditions of the coating paint application, including the heat treatment time and the concentration of the coating paint, may be adequately selected.

In the following, the present invention will be described in detail with reference to Examples and Comparative Examples, using a magnesium alloy, an aluminum alloy, a zinc alloy and an iron alloy as examples of the metal used.

(1) First, Reference will Made to the Magnesium Alloy.

(Test Piece)

First, the magnesium alloy was tested. The evaluation test base-materials used were the magnesium-alloys of ASTM standard products, AZ91D (Al: 8.5-9.5%; Zn: 0.45-0.9%, Mn: not less than 0.17%, Residual Mg-size 3×25×50 mm), AM60B (Al:6.0%, Mn:0.13%, Residual Mg-size 3×25×50 mm), ZK51A (Zn:3.6-5.0%, Zr:0.5-1.0%, Residual Mg-size 3×25×50 mm) and AZ31 (Al: 2.5-3.5%; Zn: 0.5-1.5%, Mn: not less than 0.15%, Residual Mg-size 3×25×50 mm) which were not subjected to the pre-cleaning process using acid, alkali, organic solvent or equivalent). It is to be noted that AZ91D, AM60B and ZK51 A are cast metal materials and AZ31 is an expanded metal material).

The autoclave was used for every heat treatment or heat treatment under pressure. In the autoclave, an aqueous alkaline solution wherein a manganese compound and a chelating agent are dissolved in water, or a manganese compound, a chelating agent, and either or both of a silicate and a molybdenum compound are dissolved in water, and whose pH value is adjusted to 9 or more was prepared, first. Then, the test base-materials were dipped in the aqueous solution thus prepared and then were heat-treated or heated under pressure. Thereafter, they ware washed by water and dried under hot air, to obtain the test pieces.

Manganese dihydrogen phosphate or manganous sulfate was used as the manganese compound. Etylenediamine tetrasodium tetraacetate or hydroxyethilidene disodium diphosphonate was used as the chelating agent. Sodium metasilicate was used as silicate, and sodium molybdenum was used as the molybdenum compound.

(Testing and Evaluation Method)

The corrosion resistance of the surface treatment coating thus formed was visually observed on whether the white rust occurs on the surface of the test base-material in accordance with JIS Z 2371 (salt spray test method) and the time required for the white rust to occur (hereinafter it is referred to as "rust resisting time" was measured.

The evaluation was classified into three stages with reference to the judgment standard shown in TABLE 1. The rust resisting time of less than 24 hours that falls under the category "x" means that it is likely that some problem may be caused at least in practice. The rust resisting time of 24 hours or more that falls under the category "Δ" or "○" means that it is likely that no problem may be caused at least in practice. When it takes longer before the white rust occurs, the surface treatment coating is considered to be excellent in rust resistance.

TABLE 1

| | |
|---|---|
| X | Less than 24 hours |
| Δ | 24 hours or more to less than 100 hours |
| ○ | 100 hours or more |

In evaluating the adhesion of the surface treatment coating to the corrosion-resistant paint, an urethane resin paint (e.g. Unipon 200-Series available from Nippon Paint Co., Ltd.), a silicone resin paint (e.g. Chiolight B-5007 available of Chiyoda Chemical Co., Ltd.), an epoxy resin paint (e.g. Nippe Power Bind available from Nippon Paint Co., Ltd.) and a melamine alkyd resin paint (e.g. Orgaselect 120 available form Nippon Paint Co., Ltd.) were used singly or in combination. These paints were applied to the test base-materials by use of an air spray, to form a paint film having thickness of 20 μm thereon. The tests were made according to the provision of "Cross-cut adhesion test" at Article 8.5.1 of JIS K 5400 (Paint—General test method). In detail, after a check pattern (1 mm×1 mm: 100 grids) was drawn on the test pieces, an adhesive cellophane tape prescribed by JIS Z 1522 was stuck thereon and the number of residual grids after taped up was measured.

The evaluation was classified with reference to the judgment standard shown in TABLE 2. The number of residual grids of less than 100 that falls under the category "x" means that it is likely that some problem may be caused at least in practice. The number of residual grids of 100 that falls under the category "○" means that it is likely that no problem may be caused at least in practice.

TABLE 2

| | |
|---|---|
| X | Residual grid number of less than 100 |
| ○ | Residual grid number of 100 |

EXAMPLES 1-66

In these examples, the surface treatment liquids were prepared by dissolving in water a proper quantity of manganese compound, such as manganese dihydrogen phosphate or manganous sulfate, and a chelating agent, such as hydroxyethilidene disodium diphosphonate, and, if necessary, silicate, such as sodium metasilicate or sodium orthosilicate, and/or molybdenum compound, such as sodium molybdate, so that their pH vales can be each adjusted to 9 or more. The conditions of heating under pressure, concentration of the treatment agents, pH of the treatment liquids, and their properties (evaluation results) are shown in TABLES 3 to 11. It is to be noted that when all the paints mentioned above were evaluated on adhesion of the paint, no substantial difference was found in the evaluation results. The same thing applies to the comparative examples mentioned later.

TABLE 3

| | Examples 1-8 | | | | | | | |
|---|---|---|---|---|---|---|---|---|
| | 1 | 2 | 3 | 4 | 5 | 6 | 7 | 8 |
| Condition of heating and pressing | | | | | | | | |
| temperature/pressure/time (° C./kgf/cm$^2$/min) | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | |
| Water | 92 | 92 | 92 | 92 | 92 | 87 | 87 | 87 |
| Manganese dihydrogen phosphate | 3 | 3 | 3 | 3 | 3 | 5 | 5 | 5 |
| Tetrasodium ethylenediamine tetraacetate | 5 | 5 | 5 | 5 | 5 | 8 | 8 | 8 |
| Sodium metasilicate | — | — | — | — | — | — | — | — |
| pH of surface treatment solution (20° C.) | 10.0 | 10.0 | 10.0 | 10.0 | 10.0 | 10.5 | 10.5 | 10.5 |
| Properties | | | | | | | | |
| Salt spray test AZ91D | Δ | Δ | Δ | Δ | Δ | Δ | Δ | Δ |

TABLE 3-continued

| | | Examples 1-8 | | | | | | | |
|---|---|---|---|---|---|---|---|---|---|
| | | 1 | 2 | 3 | 4 | 5 | 6 | 7 | 8 |
| (test base-material) | AM60B | Δ | Δ | Δ | Δ | Δ | Δ | Δ | Δ |
| | ZK51A | Δ | Δ | Δ | Δ | Δ | Δ | Δ | Δ |
| | AZ31 | Δ | Δ | Δ | Δ | Δ | Δ | Δ | Δ |
| Adhesion of coating | AZ91D | ○ | ○ | ○ | ○ | ○ | ○ | ○ | ○ |
| paint | AM60B | ○ | ○ | ○ | ○ | ○ | ○ | ○ | ○ |
| (test base-material) | ZK51A | ○ | ○ | ○ | ○ | ○ | ○ | ○ | ○ |
| | AZ31 | ○ | ○ | ○ | ○ | ○ | ○ | ○ | ○ |

TABLE 4

| | | Examples 9-15 | | | | | | |
|---|---|---|---|---|---|---|---|---|
| | | 9 | 10 | 11 | 12 | 13 | 14 | 15 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 87 | 87 | 75 | 75 | 75 | 75 | 75 |
| Manganese dihydrogen phosphate | | 5 | 5 | 10 | 10 | 10 | 10 | 10 |
| Tetrasodium ethylenediamine tetraacetate | | 8 | 8 | 15 | 15 | 15 | 15 | 15 |
| Sodium metasilicate | | — | — | — | — | — | — | — |
| pH of surface treatment solution (20° C.) | | 10.5 | 10.5 | 9.5 | 9.5 | 9.5 | 9.5 | 9.5 |
| Properties | | | | | | | | |
| Salt spray test | AZ91D | ○ | ○ | Δ | ○ | Δ | ○ | ○ |
| (test base-material) | AM60B | ○ | ○ | Δ | Δ | Δ | ○ | ○ |
| | ZK51A | ○ | ○ | Δ | Δ | Δ | ○ | ○ |
| | AZ31 | ○ | ○ | Δ | Δ | Δ | ○ | ○ |
| Adhesion of coating | AZ91D | ○ | ○ | ○ | ○ | ○ | ○ | ○ |
| paint | AM60B | ○ | ○ | ○ | ○ | ○ | ○ | ○ |
| (test base-material) | ZK51A | ○ | ○ | ○ | ○ | ○ | ○ | ○ |
| | AZ31 | ○ | ○ | ○ | ○ | ○ | ○ | ○ |

TABLE 5

| | | Examples 16-23 | | | | | | | |
|---|---|---|---|---|---|---|---|---|---|
| | | 16 | 17 | 18 | 19 | 20 | 21 | 22 | 23 |
| Condition of heating and pressing | | | | | | | | | |
| temperature/pressure/time (° C./kgf/cm$^2$/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 87 | 87 | 87 | 87 | 87 | 79 | 79 | 79 |
| Manganese dihydrogen phosphate | | 3 | 3 | 3 | 3 | 3 | 5 | 5 | 5 |
| Tetrasodium ethylenediamine tetraacetate | | 5 | 5 | 5 | 5 | 5 | 8 | 8 | 8 |
| Sodium metasilicate | | 5 | 5 | 5 | 5 | 5 | 8 | 8 | 8 |
| pH of surface treatment solution (20° C.) | | 11.0 | 11.0 | 11.0 | 11.0 | 11.0 | 11.2 | 11.2 | 11.2 |
| Properties | | | | | | | | | |
| Salt spray test | AZ91D | Δ | Δ | Δ | ○ | ○ | Δ | ○ | Δ |
| (test base-material) | AM60B | Δ | Δ | Δ | ○ | ○ | Δ | Δ | Δ |
| | ZK51A | Δ | Δ | Δ | ○ | ○ | Δ | Δ | Δ |
| | AZ31 | Δ | Δ | Δ | ○ | ○ | Δ | Δ | Δ |
| Adhesion of coating | AZ91D | ○ | ○ | ○ | ○ | ○ | ○ | ○ | ○ |
| paint | AM60B | ○ | ○ | ○ | ○ | ○ | ○ | ○ | ○ |

TABLE 5-continued

| | | Examples 16-23 | | | | | | | |
|---|---|---|---|---|---|---|---|---|---|
| | | 16 | 17 | 18 | 19 | 20 | 21 | 22 | 23 |
| (test base-material) | ZK51A | ○ | ○ | ○ | ○ | ○ | ○ | ○ | ○ |
| | AZ31 | ○ | ○ | ○ | ○ | ○ | ○ | ○ | ○ |

TABLE 6

| | | Examples 24-30 | | | | | | |
|---|---|---|---|---|---|---|---|---|
| | | 24 | 25 | 26 | 27 | 28 | 29 | 30 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 79 | 79 | 60 | 60 | 60 | 60 | 60 |
| Manganese dihydrogen phosphate | | 5 | 5 | 10 | 10 | 10 | 10 | 10 |
| Tetrasodium ethylenediamine tetraacetate | | 8 | 8 | 15 | 15 | 15 | 15 | 15 |
| Sodium metasilicate | | 8 | 8 | 15 | 15 | 15 | 15 | 15 |
| pH of surface treatment solution (20° C.) | | 11.2 | 11.2 | 11.5 | 11.5 | 11.5 | 11.5 | 11.5 |
| Properties | | | | | | | | |
| Salt spray test (test base-material) | AZ91D | ○ | ○ | Δ | ○ | ○ | ○ | ○ |
| | AM60B | ○ | ○ | Δ | Δ | Δ | ○ | ○ |
| | ZK51A | ○ | ○ | Δ | Δ | Δ | ○ | ○ |
| | AZ31 | ○ | ○ | Δ | Δ | Δ | ○ | ○ |
| Adhesion of coating paint (test base-material) | AZ91D | ○ | ○ | ○ | ○ | ○ | ○ | ○ |
| | AM60B | ○ | ○ | ○ | ○ | ○ | ○ | ○ |
| | ZK51A | ○ | ○ | ○ | ○ | ○ | ○ | ○ |
| | AZ31 | ○ | ○ | ○ | ○ | ○ | ○ | ○ |

TABLE 7

| | | Examples 31-38 | | | | | | | |
|---|---|---|---|---|---|---|---|---|---|
| | | 31 | 32 | 33 | 34 | 35 | 36 | 37 | 38 |
| Condition of heating and pressing | | | | | | | | | |
| temperature/pressure/time (° C./kgf/cm$^2$/mm) | | 40/0/120 | 90/0/60 | 40/0.5160 | 150/4.5/30 | 200/12/5 | 40/0/120 | 90/0/60 | 40/0.5160 |
| Concentration of surface treatment agent (%) | | | | | | | | | |
| Water | | 93 | 93 | 93 | 93 | 93 | 88 | 88 | 88 |
| Manganous sulfate | | 2 | 2 | 2 | 2 | 2 | 4 | 4 | 4 |
| Disodium hidroxyethilidene diphosphonate | | 5 | 5 | 5 | 5 | 5 | 8 | 8 | 8 |
| Sodium orthosilicate | | — | — | — | — | — | — | — | — |
| pH of surface treatment solution (20° C.) | | 10.5 | 10.5 | 10.5 | 10.5 | 10.5 | 10.0 | 10.0 | 10.0 |
| Properties | | | | | | | | | |
| Salt spray test (test base-material) | AZ91D | Δ | Δ | Δ | Δ | Δ | Δ | Δ | Δ |
| | AM60B | Δ | Δ | Δ | Δ | Δ | Δ | Δ | Δ |
| | ZK51A | Δ | Δ | Δ | Δ | Δ | Δ | Δ | Δ |
| | AZ31 | Δ | Δ | Δ | Δ | Δ | Δ | Δ | Δ |
| Adhesion of coating paint (test base-material) | AZ91D | ○ | ○ | ○ | ○ | ○ | ○ | ○ | ○ |
| | AM60B | ○ | ○ | ○ | ○ | ○ | ○ | ○ | ○ |
| | ZK51A | ○ | ○ | ○ | ○ | ○ | ○ | ○ | ○ |
| | AZ31 | ○ | ○ | ○ | ○ | ○ | ○ | ○ | ○ |

TABLE 8

| | | Examples 39-45 | | | | | | |
|---|---|---|---|---|---|---|---|---|
| | | 39 | 40 | 41 | 42 | 43 | 44 | 45 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 88 | 88 | 75 | 75 | 75 | 75 | 75 |
| Manganous sulfate | | 4 | 4 | 10 | 10 | 10 | 10 | 10 |
| Disodium hidroxyetbilidene diphosphonate | | 8 | 8 | 15 | 15 | 15 | 15 | 15 |
| Sodium orthosilicate | | — | — | — | — | — | — | — |
| pH of surface treatment solution (20° C.) | | 10.0 | 10.0 | 9.5 | 9.5 | 9.5 | 9.5 | 9.5 |
| Properties | | | | | | | | |
| Salt spray test | AZ91D | Δ | Δ | Δ | Δ | Δ | Δ | Δ |
| (test base-material) | AM60B | Δ | Δ | Δ | Δ | Δ | Δ | Δ |
| | ZK51A | Δ | Δ | Δ | Δ | Δ | Δ | Δ |
| | AZ31 | Δ | Δ | Δ | Δ | Δ | Δ | Δ |
| Adhesion of coating | AZ91D | ○ | ○ | ○ | ○ | ○ | ○ | ○ |
| paint | AM60B | ○ | ○ | ○ | ○ | ○ | ○ | ○ |
| (test base-material) | ZK51A | ○ | ○ | ○ | ○ | ○ | ○ | ○ |
| | AZ31 | ○ | ○ | ○ | ○ | ○ | ○ | ○ |

TABLE 9

| | | Examples 46-53 | | | | | | | |
|---|---|---|---|---|---|---|---|---|---|
| | | 46 | 47 | 48 | 49 | 50 | 51 | 52 | 53 |
| Condition of heating and pressing | | | | | | | | | |
| temperature/pressure/time (° C./kgf/cm2/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 88 | 88 | 88 | 88 | 88 | 80 | 80 | 80 |
| Manganous sulfate | | 2 | 2 | 2 | 2 | 2 | 4 | 4 | 4 |
| Disodium hidroxyethilidene diphosphonate | | 5 | 5 | 5 | 5 | 5 | 8 | 8 | 8 |
| Sodium orthosilicate | | 5 | 5 | 5 | 5 | 5 | 8 | 8 | 8 |
| pH of surface treatment solution (20° C.) | | 11.0 | 11.0 | 11.0 | 11.0 | 11.0 | 11.2 | 11.2 | 11.2 |
| Properties | | | | | | | | | |
| Salt spray test | AZ91D | Δ | Δ | Δ | ○ | ○ | Δ | Δ | Δ |
| (test base-material) | AM60B | Δ | Δ | Δ | ○ | ○ | Δ | Δ | Δ |
| | ZK51A | Δ | Δ | Δ | ○ | ○ | Δ | Δ | Δ |
| | AZ31 | Δ | Δ | Δ | ○ | ○ | Δ | Δ | Δ |
| Adhesion of coating | A291D | ○ | ○ | ○ | ○ | ○ | ○ | ○ | ○ |
| paint | AM60B | ○ | ○ | ○ | ○ | ○ | ○ | ○ | ○ |
| (test base-material) | ZK51A | ○ | ○ | ○ | ○ | ○ | ○ | ○ | ○ |
| | AZ31 | ○ | ○ | ○ | ○ | ○ | ○ | ○ | ○ |

TABLE 10

| | | Examples 54-60 | | | | | | |
|---|---|---|---|---|---|---|---|---|
| | | 54 | 55 | 56 | 57 | 58 | 59 | 60 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 80 | 80 | 60 | 60 | 60 | 60 | 60 |
| Manganous sulfate | | 4 | 4 | 10 | 10 | 10 | 10 | 10 |
| Disodium hidroxyethilidene diphosphonate | | 8 | 8 | 15 | 15 | 15 | 15 | 15 |
| Sodium orthosilicate | | 8 | 8 | 15 | 15 | 15 | 15 | 15 |
| pH of surface treatment solution (20° C.) | | 11.2 | 11.2 | 11.5 | 11.5 | 11.5 | 11.5 | 11.5 |
| Properties | | | | | | | | |
| Salt spray test (test base-material) | AZ91D | ○ | ○ | Δ | Δ | ○ | ○ | ○ |
| | AM60B | ○ | ○ | Δ | Δ | Δ | ○ | ○ |
| | ZK51A | ○ | ○ | Δ | Δ | Δ | ○ | ○ |
| | AZ31 | ○ | ○ | Δ | Δ | Δ | ○ | ○ |
| Adhesion of coating paint (test base-material) | AZ91D | ○ | ○ | ○ | ○ | ○ | ○ | ○ |
| | AM60B | ○ | ○ | ○ | ○ | ○ | ○ | ○ |
| | ZK51A | ○ | ○ | ○ | ○ | ○ | ○ | ○ |
| | AZ31 | ○ | ○ | ○ | ○ | ○ | ○ | ○ |

TABLE 11

| | | Examples 61-66 | | | | | |
|---|---|---|---|---|---|---|---|
| | | 61 | 62 | 63 | 64 | 65 | 66 |
| Condition of heating and pressing | | | | | | | |
| temperature/pressure/time (° C./kgf/cm$^2$/min) | | 150/4.5/30 | 150/4.5/30 | 150/4.5/30 | 150/4.5/30 | 150/4.5/30 | 150/4.5/30 |
| Concentration of surface treatment agent (%) | | | | | | | |
| Water | | 89 | 82 | 65 | 84 | 74 | 55 |
| Manganese dihydrogen phosphate | | 3 | 5 | 10 | 3 | 5 | 10 |
| Tetrasodium ethylenediamine tetraacetate | | 5 | 8 | 15 | 5 | 8 | 15 |
| Sodium metasilicate | | — | — | — | 5 | 8 | 10 |
| Sodium molybdate | | 3 | 5 | 10 | 3 | 5 | 10 |
| pH of surface treatment solution (20° C.) | | 10.0 | 10.5 | 9.5 | 11.0 | 11.2 | 11.5 |
| Properties | | | | | | | |
| Salt spray test (test base-material) | AZ91D | ○ | ○ | ○ | ○ | ○ | ○ |
| | AM60B | ○ | ○ | ○ | ○ | ○ | ○ |
| | ZK51A | ○ | ○ | ○ | ○ | ○ | ○ |
| | AZ31 | ○ | ○ | ○ | ○ | ○ | ○ |
| Adhesion of coating paint (test base-material) | AZ91D | ○ | ○ | ○ | ○ | ○ | ○ |
| | AM60B | ○ | ○ | ○ | ○ | ○ | ○ |
| | ZK51A | ○ | ○ | ○ | ○ | ○ | ○ |
| | AZ31 | ○ | ○ | ○ | ○ | ○ | ○ |

COMPARATIVE EXAMPLES 1-91

The treatment agents used as the surface treatment liquids are identical in type to those of Examples 1-66. The surface treatment methods which are not considered to be adequate in terms of condition of heating under pressure or concentration or pH of the treatment agents are cited as Comparative Examples. The conditions of heating under pressure, concentration of the treatment agents and pH of the treatment liquids, and their properties (evaluation results) are shown in TABLES 12 to 23.

TABLE 12

| | | Comparative Examples 1-8 | | | | | | | |
|---|---|---|---|---|---|---|---|---|---|
| | | 1 | 2 | 3 | 4 | 5 | 6 | 7 | 8 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |
| Concentration of surface treatment agent (%) | | | | | | | | | |
| Water | | 92 | 92 | 92 | 92 | 87 | 87 | 87 | 87 |
| Manganese dihydrogen phosphate | | 3 | 3 | 3 | 3 | 5 | 5 | 5 | 5 |
| Tetrasodium ethylenediamine tetraacetate | | 5 | 5 | 5 | 5 | 8 | 8 | 8 | 8 |
| Sodium metasilicate | | — | — | — | — | — | — | — | — |
| pH of surface treatment solution (20° C.) | | 10.0 | 10.0 | 10.0 | 100 | 10.5 | 10.5 | 10.5 | 10.5 |
| Properties | | | | | | | | | |
| Salt spray test (test base-material) | AZ91D | X | X | X | X | X | X | X | X |
| | AM60B | X | X | X | X | X | X | X | X |
| | ZK51A | X | X | X | X | X | X | X | X |
| | AZ31 | X | X | X | X | X | X | X | X |
| Adhesion of coating paint (test base-material) | AZ91D | X | X | X | X | X | X | X | X |
| | AM60B | X | X | X | X | X | X | X | X |
| | ZK51A | X | X | X | X | X | X | X | X |
| | AZ31 | X | X | X | X | X | X | X | X |

TABLE 13

| | | Comparative Examples 9–16 | | | | | | | |
|---|---|---|---|---|---|---|---|---|---|
| | | 9 | 10 | 11 | 12 | 13 | 14 | 15 | 16 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 75 | 75 | 75 | 75 | 65 | 65 | 65 | 65 |
| Manganese dihydrogen phosphate | | 10 | 10 | 10 | 10 | 15 | 15 | 15 | 15 |
| Tetrasodium ethylenediamine tetraacetate | | 15 | 15 | 15 | 15 | 20 | 20 | 20 | 20 |
| Sodium metasilicate | | — | — | — | — | — | — | — | — |
| pH of surface treatment solution (20° C.) | | 9.5 | 9.5 | 9.5 | 9.5 | 9.5 | 9.5 | 9.5 | 9.5 |
| Properties | | | | | | | | | |
| Salt spray test (test base-material) | AZ91D | X | X | X | X | Δ | ○ | Δ | ○ |
| | AM60B | X | X | X | X | Δ | Δ | Δ | ○ |
| | ZK51A | X | X | X | X | Δ | Δ | Δ | ○ |
| | AZ31 | X | X | X | X | Δ | Δ | Δ | ○ |
| Adhesion of coating paint (test base-material) | AZ91D | X | X | X | X | X | X | X | X |
| | AM60B | X | X | X | X | X | X | X | X |
| | ZK51A | X | X | X | X | X | X | X | X |
| | AZ31 | X | X | X | X | X | X | X | X |

TABLE 14

| | Comparative Examples 17–24 | | | | | | | |
|---|---|---|---|---|---|---|---|---|
| | 17 | 18 | 19 | 20 | 21 | 22 | 23 | 24 |
| Condition of heating and pressing | | | | | | | | |
| temperature/pressure/time (° C./kgf/cm$^2$/min) | 30/0/60 | 30/0.2/30 | 30/0.2/60 | 200/12/0.5 | 30/0/60 | 30/0.2/30 | 30/0.2/60 | 200/12/0.5 |
| Concentration of surface | | | | | | | | |

TABLE 14-continued

| | | Comparative Examples 17–24 | | | | | | | |
|---|---|---|---|---|---|---|---|---|---|
| | | 17 | 18 | 19 | 20 | 21 | 22 | 23 | 24 |
| treatment agent (%) | | | | | | | | | |
| Water | | 87 | 87 | 87 | 87 | 79 | 79 | 79 | 79 |
| Manganese dihydrogen phosphate | | 3 | 3 | 3 | 3 | 5 | 5 | 5 | 5 |
| Tetrasodium ethylenediamine tetraacetate | | 5 | 5 | 5 | 5 | 8 | 8 | 8 | 8 |
| Sodium metasilicate | | 5 | 5 | 5 | 5 | 8 | 8 | 8 | 8 |
| pH of surface treatment solution (20° C.) | | 11.0 | 11.0 | 11.0 | 11.0 | 11.2 | 11.2 | 11.2 | 11.2 |
| Properties | | | | | | | | | |
| Salt spray test (test base-material) | AZ91D | X | X | X | X | X | X | X | X |
| | AM60B | X | X | X | X | X | X | X | X |
| | ZK51A | X | X | X | X | X | X | X | X |
| | AZ31 | X | X | X | X | X | X | X | X |
| Adhesion of coating paint (test base-material) | AZ91D | X | X | X | X | X | X | X | X |
| | AM60B | X | X | X | X | X | X | X | X |
| | ZK51A | X | X | X | X | X | X | X | X |
| | AZ31 | X | X | X | X | X | X | X | X |

TABLE 15

| | | Comparative Examples 25–32 | | | | | | | |
|---|---|---|---|---|---|---|---|---|---|
| | | 25 | 26 | 27 | 28 | 29 | 30 | 31 | 32 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 60 | 60 | 60 | 60 | 45 | 45 | 45 | 45 |
| Manganese dihydrogen phosphate | | 10 | 10 | 10 | 10 | 15 | 15 | 15 | 15 |
| Tetrasodium ethylenediamine tetraacetate | | 15 | 15 | 15 | 15 | 20 | 20 | 20 | 20 |
| Sodium metasilicate | | 15 | 15 | 15 | 15 | 20 | 20 | 20 | 20 |
| pH of surface treatment solution (20° C.) | | 11.5 | 11.5 | 11.5 | 11.5 | 11.7 | 11.7 | 11.7 | 11.7 |
| Properties | | | | | | | | | |
| Salt spray test (test base-material) | AZ91D | X | X | X | X | Δ | ○ | ○ | ○ |
| | AM60B | X | X | X | X | Δ | Δ | Δ | ○ |
| | ZK51A | X | X | X | X | Δ | Δ | Δ | ○ |
| | AZ31 | X | X | X | X | Δ | Δ | Δ | ○ |
| Adhesion of coating paint (test base-material) | AZ91D | X | X | X | X | X | X | X | X |
| | AM60B | X | X | X | X | X | X | X | X |
| | ZK51A | X | X | X | X | X | X | X | X |
| | AZ31 | X | X | X | X | X | X | X | X |

TABLE 16

| | | Comparative Examples 33–40 | | | | | | | |
|---|---|---|---|---|---|---|---|---|---|
| | | 33 | 34 | 35 | 36 | 37 | 38 | 39 | 40 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |
| Concentration of surface treatment agent (%) | | | | | | | | | |
| Water | | 93 | 93 | 93 | 93 | 88 | 88 | 88 | 88 |
| Manganous sulfate | | 2 | 2 | 2 | 2 | 4 | 4 | 4 | 4 |
| Disodium hidroxyethilidene diphosphonate | | 5 | 5 | 5 | 5 | 8 | 8 | 8 | 8 |

TABLE 16-continued

| | | Comparative Examples 33–40 | | | | | | | |
|---|---|---|---|---|---|---|---|---|---|
| | | 33 | 34 | 35 | 36 | 37 | 38 | 39 | 40 |
| Sodium orthosilicate | | — | — | — | — | — | — | — | — |
| pH of surface treatment solution (20° C.) | | 10.5 | 10.5 | 10.5 | 10.5 | 10.0 | 10.0 | 10.0 | 10.0 |
| Properties | | | | | | | | | |
| Salt spray test | AZ91D | X | X | X | X | X | X | X | X |
| (test base-material) | AM60B | X | X | X | X | X | X | X | X |
| | ZK51A | X | X | X | X | X | X | X | X |
| | AZ31 | X | X | X | X | X | X | X | X |
| Adhesion of coating | AZ91D | X | X | X | X | X | X | X | X |
| paint | AM60B | X | X | X | X | X | X | X | X |
| (test base-material) | ZK51A | X | X | X | X | X | X | X | X |
| | AZ31 | X | X | X | X | X | X | X | X |

TABLE 17

| | | Comparative Examples 41–48 | | | | | | | |
|---|---|---|---|---|---|---|---|---|---|
| | | 41 | 42 | 43 | 44 | 45 | 46 | 47 | 48 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 75 | 75 | 75 | 75 | 65 | 65 | 65 | 65 |
| Manganous sulfate | | 10 | 10 | 10 | 10 | 15 | 15 | 15 | 15 |
| Disodium hidroxyethilidene diphosphonate | | 15 | 15 | 15 | 15 | 20 | 20 | 20 | 20 |
| Sodium orthosilicate | | — | — | — | — | — | — | — | — |
| pH of surface treatment solution (20° C.) | | 9.5 | 9.5 | 9.5 | 9.5 | 9.5 | 9.5 | 9.5 | 9.5 |
| Properties | | | | | | | | | |
| Salt spray test | AZ91D | X | X | X | X | Δ | Δ | Δ | ○ |
| (test base-material) | AM60B | X | X | X | X | Δ | Δ | Δ | ○ |
| | ZK51A | X | X | X | X | Δ | Δ | Δ | ○ |
| | AZ31 | X | X | X | X | Δ | Δ | Δ | ○ |
| Adhesion of coating | AZ91D | X | X | X | X | X | X | X | X |
| paint | AM60B | X | X | X | X | X | X | X | X |
| (test base-material) | ZK51A | X | X | X | X | X | X | X | X |
| | AZ31 | X | X | X | X | X | X | X | X |

TABLE 18

| | | Comparative Examples 49–56 | | | | | | | |
|---|---|---|---|---|---|---|---|---|---|
| | | 49 | 50 | 51 | 52 | 53 | 54 | 55 | 56 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |
| Concentration of surface treatment agent (%) | | | | | | | | | |
| Water | | 88 | 88 | 88 | 88 | 80 | 80 | 80 | 80 |
| Manganous sulfate | | 2 | 2 | 2 | 2 | 4 | 4 | 4 | 4 |
| Disodium hidroxyethilidene diphosphonate | | 5 | 5 | 5 | 5 | 8 | 8 | 8 | 8 |
| Sodium orthosilicate | | 5 | 5 | 5 | 5 | 8 | 8 | 8 | 8 |
| pH of surface treatment solution (20° C.) | | 11.0 | 11.0 | 11.0 | 11.0 | 11.2 | 11.2 | 11.2 | 11.2 |
| Properties | | | | | | | | | |
| Salt spray test | AZ91D | X | X | X | X | X | X | X | X |
| (test base-material) | AM60B | X | X | X | X | X | X | X | X |
| | ZK51A | X | X | X | X | X | X | X | X |
| | AZ31 | X | X | X | X | X | X | X | X |

TABLE 18-continued

| | | Comparative Examples 49–56 | | | | | | | |
|---|---|---|---|---|---|---|---|---|---|
| | | 49 | 50 | 51 | 52 | 53 | 54 | 55 | 56 |
| Adhesion of coating | AZ91D | X | X | X | X | X | X | X | X |
| paint | AM60B | X | X | X | X | X | X | X | X |
| (test base-material) | ZK51A | X | X | X | X | X | X | X | X |
| | AZ31 | X | X | X | X | X | X | X | X |

TABLE 19

| | | Comparative Examples 57–64 | | | | | | | |
|---|---|---|---|---|---|---|---|---|---|
| | | 57 | 58 | 59 | 60 | 61 | 62 | 63 | 64 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 60 | 60 | 60 | 60 | 45 | 45 | 45 | 45 |
| Manganous sulfate | | 10 | 10 | 10 | 10 | 15 | 15 | 15 | 15 |
| Disodium hidroxyethilidene diphosphonate | | 15 | 15 | 15 | 15 | 20 | 20 | 20 | 20 |
| Sodium orthosilicate | | 15 | 15 | 15 | 15 | 20 | 20 | 20 | 20 |
| pH of surface treatment solution (20° C.) | | 11.5 | 11.5 | 11.5 | 11.5 | 11.8 | 11.8 | 11.8 | 11.8 |
| Properties | | | | | | | | | |
| Salt spray test | AZ91D | X | X | X | X | Δ | Δ | Δ | ○ |
| (test base-material) | AM60B | X | X | X | X | Δ | Δ | Δ | ○ |
| | ZK51A | X | X | X | X | Δ | Δ | Δ | ○ |
| | AZ31 | X | X | X | X | Δ | Δ | Δ | ○ |
| Adhesion of coating | AZ91D | X | X | X | X | X | X | X | X |
| paint | AM60B | X | X | X | X | X | X | X | X |
| (test base-material) | ZK51A | X | X | X | X | X | X | X | X |
| | AZ31 | X | X | X | X | X | X | X | X |

TABLE 20

| | | Comparative Examples 65–70 | | | | | |
|---|---|---|---|---|---|---|---|
| | | 65 | 66 | 67 | 68 | 69 | 70 |
| Condition of heating and pressing | | | | | | | |
| temperature/pressure/time (° C./kgf/cm$^2$/min) | | 30/0/60 | 30/0/60 | 30/0/60 | 30/0/60 | 30/0/60 | 30/0/60 |
| Concentration of surface treatment agent (%) | | | | | | | |
| Water | | 89 | 89 | 82 | 82 | 65 | 65 |
| Manganese dihydrogen phosphate | | 3 | 3 | 5 | 5 | 10 | 10 |
| Tetrasodium ethylenediamine tetraacetate | | 5 | 5 | 8 | 8 | 15 | 15 |
| Sodium molybdate | | 3 | 3 | 5 | 5 | 10 | 10 |
| pH of surface treatment solution (20° C.) | | 10.0 | 10.0 | 10.5 | 10.5 | 9.5 | 9.5 |
| Properties | | | | | | | |
| Salt spray test | AZ91D | X | X | X | X | X | X |
| (test base-material) | AM60B | X | X | X | X | X | X |
| | ZK51A | X | X | X | X | X | X |
| | AZ31 | X | X | X | X | X | X |
| Adhesion of coating | AZ91D | X | X | X | X | X | X |
| paint | AM60B | X | X | X | X | X | X |
| (test base-material) | ZK51A | X | X | X | X | X | X |
| | AZ31 | X | X | X | X | X | X |

TABLE 21

| | | Comparative Examples 71–77 | | | | | | |
|---|---|---|---|---|---|---|---|---|
| | | 71 | 72 | 73 | 74 | 75 | 76 | 77 |
| Condition of heating and pressing | | | | | | | | |
| temperature/pressure/time (° C./kgf/cm$^2$/min) | | 30/0/60 | 30/0/60 | 30/0/60 | 30/0/60 | 30/0/60 | 30/0/60 | 150/4.5/30 |
| Concentration of surface treatment agent (%) | | | | | | | | |
| Water | | 84 | 84 | 74 | 74 | 55 | 55 | 30 |
| Manganese dihydrogen phosphate | | 3 | 3 | 5 | 5 | 10 | 10 | 15 |
| Tetrasodium ethylenediamine tetraacetate | | 5 | 5 | 8 | 8 | 15 | 15 | 20 |
| Sodium metasilicate | | 5 | 5 | 8 | 8 | 10 | 10 | 20 |
| Sodium molybdate | | 3 | 3 | 5 | 5 | 10 | 10 | 15 |
| pH of surface treatment solution (20° C.) | | 11.0 | 11.0 | 11.2 | 11.2 | 11.5 | 11.5 | 11.7 |
| Properties | | | | | | | | |
| Salt spray test | AZ91D | X | X | X | X | X | X | ○ |
| (test base-material) | AM60B | X | X | X | X | X | X | ○ |
| | ZK51A | X | X | X | X | X | X | ○ |
| | AZ31 | X | X | X | X | X | X | ○ |
| Adhesion of coating | AZ91D | X | X | X | X | X | X | X |
| paint | AM60B | X | X | X | X | X | X | X |
| (test base-material) | ZK51A | X | X | X | X | X | X | X |
| | AZ31 | X | X | X | X | X | X | X |

TABLE 22

| | Comparative Examples 78–85 | | | | | | | |
|---|---|---|---|---|---|---|---|---|
| | 78 | 79 | 80 | 81 | 82 | 83 | 84 | 85 |
| Condition of heating and pressing | | | | | | | | |
| temperature/pressure/time (° C./kgf/cm$^2$/min) | 150/4.5/30 | 150/4.5/30 | 150/4.5/30 | 150/4.5/30 | 150/4.5/30 | 150/4.5/30 | 150/4.5/30 | 150/4.5/30 |
| Concentration of surface treatment agent (%) | | | | | | | | |
| Water | 92 | 87 | 75 | 90 | 83 | 67 | 91 | 89 |
| Manganese dihydrogen phosphate | 3 | 5 | 10 | 3 | 5 | 10 | 3 | 3 |
| Tetrasodium ethylenediamine tetraacetate | 5 | 8 | 15 | 5 | 8 | 15 | 3 | 3 |
| Sodium metasilicate | — | — | — | 2 | 4 | 8 | — | 2 |
| Sodium molybdate | — | — | — | — | — | — | 3 | 3 |
| pH of surface treatment solution (20° C.) | 5.0 | 5.0 | 5.0 | 8.0 | 8.0 | 8.0 | 6.0 | 7.0 |

TABLE 22-continued

| | Comparative Examples 78–85 | | | | | | | |
|---|---|---|---|---|---|---|---|---|
| | 78 | 79 | 80 | 81 | 82 | 83 | 84 | 85 |
| Change in dimension and surface profile of test piece (test base-material) | | | | | | | | |
| AZ91D | Change of dimension and corrosion of surface are found | | | | | | | |
| AM60B | Change of dimension and corrosion of surface are found | | | | | | | |
| ZK51A | Change of dimension and corrosion of surface are found | | | | | | | |
| AZ31 | Change of dimension and corrosion of surface are found | | | | | | | |

TABLE 23

| | Comparative Examples 86-91 | | | | | |
|---|---|---|---|---|---|---|
| | 86 | 87 | 88 | 89 | 90 | 91 |
| Condition of heating and pressing | | | | | | |
| temperature/pressure/time (° C./kgf/cm$^2$/min) | 150/4.5/30 | 150/4.5/30 | 150/4.5/30 | 150/4.5/30 | 150/4.5/30 | 150/4.5/30 |
| Concentration of surface treatment agent (%) | | | | | | |
| Water | 94 | 90 | 80 | 92 | 86 | 72 |
| Manganous sulfate | 3 | 5 | 10 | 3 | 5 | 10 |
| Disodium hidroxyethilidene diphosphonate | 3 | 5 | 10 | 3 | 5 | 10 |
| Sodium orthosilicate | — | — | — | 2 | 4 | 8 |
| pH of surface treatment solution (20° C.) | 5.0 | 5.0 | 5.0 | 8.0 | 8.0 | 8.0 |
| Change in dimension and surface profile of test piece (test base-material) | | | | | | |
| AZ91D | Change of dimension and corrosion of surface are found | | | | | |
| AM60B | Change of dimension and corrosion of surface are found | | | | | |
| ZK51A | Change of dimension and corrosion of surface are found | | | | | |
| AZ31 | Change of dimension and corrosion of surface are found | | | | | |

* Change of dimension and corrosion of surface are found in the non-surface treated base materials of AZ91D, AM60B, ZK51A, and AZ31 within an hour From comparison between Examples 1-66 of TABLES 3-11 and Comparative Examples 1-91 of TABLES 12-23 it was found that all Examples 1-66 were acceptable in that the rust resisting time in the salt spray test was 24 hours or more, as well as in adhesion of the paint. In contrast to this, it was found therefrom that Comparative Examples 1-77 were all rejected in terms of adhesion of the paint, and Comparative Examples 78-91 were all less than 9 in pH of the surface treatment liquid, such that the change (reduction) of dimension resulting from corrosion or the corrosion of surface was found.

It should be noted that when the same test was made of the non-surface-treated, test base-materials, it was found that those were all rejected in that the change of dimension and corrosion of surface were found within an hour in those test base-materials in the salt spray test and were also rejected in the paint adhesion test, of course.

Following facts were found from the salt spray test results of Comparative Examples.

Comparative Examples 1-3, 5-11, 17-19, 21-23, 25-27, 33-35, 37-39, 41-43, 49-51, 53-55, 57-59 and 65-76 were rejected. This is because the surface treatment conditions were not fulfilled in that the heating temperature was as low as 30° C. (less than 35° C.), the pressure was zero or 0.2 kgf/cm$^2$, etc. Comparative Examples 4, 8, 12, 20, 24, 28, 36, 40, 44, 56 and 60 were rejected. This is because although the heating temperature was as high as 200° C. and also the pressure was as high as 12 kgf, the processing time was as significantly short as 0.5 min (less than one minute). Comparative Examples 13-16, 29-32, 45-48 and 61-64 were evaluated to be acceptable in the salt spray test, despite of being rejected in terms of adhesion of the paint. This is probably because the surface treatment conditions were adequate.

Comparative Examples 13-16, 29-32, 45-48 and 61-64 were rejected in terms of adhesion of the paint, despite of being adequate in the surface treatment conditions. This is due to the concentration of components of the surface treatment liquid. In Comparative Examples 13-16, the manganese dihydrogen phosphate concentration was in excess of 10% and the ethylenediamine tetrasodium tetraacetate concentration was in excess of 15%. In Comparative Examples 29-32, the sodium metasilicate concentration was in excess of 15%, in addition to those concentrations. This probably caused the residual of the surface treatment liquid to adhere to the surface of the test pieces, resulting in the rejection. Comparative Examples 45-48, the manganous sulfate concentration was in excess of 10% and the hydroxyethilidene disodium diphosphonate concentration was in excess of 15%. In Comparative Examples 61-64, the sodium orthosilicate concentration was in excess of 15%, in addition to those concentrations. This probably caused the residual of the surface treatment liquid to adhere to the surface of the test pieces, resulting in the rejection. Examples using the aqueous solution to which no silicate or molybdenum compound was added (Examples 1-15 and 31-45) were all evaluated to fall under the category "Δ" in the salt spray test. On the other hand, some of Examples using the aqueous solution to which silicate or molybdenum compound was added (Examples 16-30 and 46-66) were evaluated to fall under the category "○" in the salt spray test. It can be said from this fact that the addition of silicate or molybdenum produced an improved rust resistance.

Examples using the aqueous solution to which no silicate or molybdenum compound was added (Examples 1-15 and 31-45) were all evaluated to fall under the category "Δ" in the salt spray test (the rust resisting time in the range of 24 hours or more to less than 100 hours). On the other hand, some of Examples using the aqueous solution to which silicate or molybdenum compound was added (Examples 16-30 and 46-66) were evaluated to fall under the category "○" in the salt spray test (the rust resisting time of 100 hours or more) under the conditions of heating under pressure: 150° C./4.5 kgf/cm$^2$/30 minutes or 200° C./12 kgf/cm$^2$/5 minutes. It can be said from this fact that the addition of silicate or molybdenum compound produced an improved rust resistance as a whole.

(2) Second, Reference will be Made to the Aluminum Alloy.

(Test Piece)

The evaluation test base-materials of the aluminum-alloys used were: JIS standard product ADC12 (Cu: 1.50-3.5%; Si: 9.6-12.0%, Mg: not more than 0.3%, Zn: not more than 1.0%, Ni: not more than 0.5%, Fe: not more than 1.3%, Mn: not more than 0.3%, Sn: not more than 0.3%, and Residual Al-size 3×25×50 mm); ASTM standard product A356.0 (Cu: not more than 0.20%; Si: 6.5-7.5%, Mg: 0.25-0.45%, Zn: not more than 0.10%, Fe: not more than 0.20%, Mn: not more than 0.10%, Ti: not more than 0.20%, and Residual Al-size 3×25×50 mm); ASTM standard product 1050 (Si: not more than 0.25%, Fe: not more than 0.40%, Cu: not more than 0.05%, Mn: not more than 0.05%, Mg: not more than 0.05%, Zn: not more than 0.05%, Ti: not more than 0.03% and Residual Al-size 2×25×50 mm); ASTM standard product 2024 (Si: not more than 0.50%, Fe: not more than 0.50%, Cu: 3.8-4.9%, Mn: 0.30-0.9%, Mg: 1.2-1.8%, Cr: not more than 0.10%, Zn: not more than 0.25%, Ti: not more than 0.15% and Residual Al-size 2×25×50 mm); ASTM standard product 3003 (Si: not more than 0.6%, Fe: not more than 0.7%, Cu: 0.05-0.20%, Mn: 1.0-1.5%, Zn: not more than 0.10% and Residual Al-size 2×25×50 mm); ASTM standard product 4032 (Si: 11.0-13.5%, Fe: not more than 1.0%, Cu: 0.50-1.3%, Mg: 0.8-1.3%, Cu: not more than 0.10, Zn: not more than 0.25%, Ni: 0.50-1.30 and Residual Al-size 2×25×50 mm); and ASTM standard product 5032 (Si: not more than 0.40%, Fe: not more than 0.40%, Cu: not more than 0.10%, Mn: 0.40-1,0%, Mg: 4.0-4.9%, Cr: 0.05-0.25%, Zn: not more than 0.25%, Ti: not more than 0.15% and Residual Al-size 2×25×50 mm), all of which were not subjected to the pre-cleaning process using acid, alkali, or organic solvent. It is to be noted that ADC12 and A356 are cast metal materials, and 1050, 2024, 3003 and 4032 are expanded metal materials.

The surface treatment of the aluminum alloys was made in the same manner as in that of the magnesium alloys.

(Testing and Evaluation Method)

The corrosion resistance of the surface treatment coating thus formed was visually observed on whether the white rust occurs on the surface of the test base-material in accordance with JIS Z 2371 (salt spray test method) and the time required for the white rust to occur (hereinafter it is referred to as "rust resisting time" was measured in the same manner as in that of the magnesium alloys. The evaluation was classified into three stages with reference to the judgment standard shown in TABLE 24 (which corresponds to TABLE 1). The rust resisting time of less than 24 hours that falls under the category "x" means that it is likely that some problem may be caused at least in practice. The rust resisting time of 24 hours or more that falls under the category "Δ" or "○" means that it is likely that no problem may be caused at least in practice. When it takes longer before the white rust occurs, the surface treatment coating is considered to be excellent in rust resistance.

TABLE 24

| | |
|---|---|
| X | Less than 24 hours |
| Δ | 24 hours or more to less than 100 hours |
| ○ | 100 hours or more |

In evaluating the adhesion of the surface treatment coating to the corrosion-resistant paint, the same paints as those in the magnesium alloys were used and applied to the test base-materials in the same manner as in the magnesium alloys, to form a paint film having thickness of 20 μm thereon. The tests were made according to the provision of "Cross-cut adhesion test" at Article 8.5.1 of JIS K 5400 (Paint—General test method). In detail, after a check pattern (1 mm×1 mm: 100 grids) was drawn on the test pieces, an adhesive cellophane tape prescribed by JIS Z 1522 was stuck thereon and the number of residual grids after taped up was measured.

The evaluation was classified with reference to the judgment standard shown in TABLE 25 (which corresponds to TABLE 2). The number of residual grids of less than 100 that falls under the category "x" means that it is likely that some problem may be caused at least in practice. The number of residual grids of 100 that falls under the category "○" means that it is likely that no problem may be caused at least in practice.

TABLE 25

| | |
|---|---|
| X | Residual grid number of less than 100 |
| ○ | Residual grid number of 100 |

EXAMPLES 67-132

In these examples, the same surface treatment liquids as those in the Examples using the magnesium alloys were used for the surface treatment of the aluminum alloy specimens. The conditions of heating under pressure, concentration of the treatment agents, pH of the treatment liquids, and their properties (evaluation results) are shown in TABLES 26 to 34. It is to be noted that when all the paints mentioned above were evaluated on adhesion of the paint, no substantial difference was found in the evaluation results. The same thing applies to the comparative examples mentioned later.

TABLE 26

| | | Examples 67-74 | | | | | | | |
|---|---|---|---|---|---|---|---|---|---|
| | | 67 | 68 | 69 | 70 | 71 | 72 | 73 | 74 |
| Condition of heating and pressing | | | | | | | | | |
| temperature/pressure/time (° C./kgf/cm$^2$/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 92 | 92 | 92 | 92 | 92 | 87 | 87 | 87 |
| Manganese dihydrogen phosphate | | 3 | 3 | 3 | 3 | 3 | 5 | 5 | 5 |
| Tetrasodium ethylenediamine tetraacetate | | 5 | 5 | 5 | 5 | 5 | 8 | 8 | 8 |
| Sodium metasilicate | | — | — | — | — | — | — | — | — |
| pH of surface treatment solution (20° C.) | | 10.0 | 10.0 | 10.0 | 10.0 | 10.0 | 10.5 | 10.5 | 10.5 |
| Properties | | | | | | | | | |
| Salt spray test (test base-material) | ADC12 | Δ | Δ | Δ | ○ | ○ | Δ | Δ | Δ |
| | A356.0 | Δ | Δ | Δ | ○ | ○ | Δ | Δ | Δ |
| | 1050 | Δ | Δ | ○ | ○ | ○ | Δ | Δ | Δ |
| | 2024 | Δ | Δ | Δ | ○ | Δ | Δ | Δ | Δ |
| | 3003 | Δ | Δ | ○ | ○ | ○ | Δ | Δ | Δ |
| | 4032 | Δ | Δ | ○ | ○ | ○ | Δ | Δ | Δ |
| | 5083 | Δ | Δ | ○ | ○ | Δ | Δ | Δ | Δ |
| Adhesion of coating paint (test base-material) | ADC12 | ○ | ○ | ○ | ○ | ○ | ○ | ○ | ○ |
| | A356.0 | ○ | ○ | ○ | ○ | ○ | ○ | ○ | ○ |
| | 1050 | ○ | ○ | ○ | ○ | ○ | ○ | ○ | ○ |
| | 2024 | ○ | ○ | ○ | ○ | ○ | ○ | ○ | ○ |
| | 3003 | ○ | ○ | ○ | ○ | ○ | ○ | ○ | ○ |
| | 4032 | ○ | ○ | ○ | ○ | ○ | ○ | ○ | ○ |
| | 5083 | ○ | ○ | ○ | ○ | ○ | ○ | ○ | ○ |

TABLE 27

| | | Examples 75-81 | | | | | | |
|---|---|---|---|---|---|---|---|---|
| | | 75 | 76 | 77 | 78 | 79 | 80 | 81 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 87 | 87 | 75 | 75 | 75 | 75 | 75 |
| Manganese dihydrogen phosphate | | 5 | 5 | 10 | 10 | 10 | 10 | 10 |
| Tetrasodium ethylenediamine tetraacetate | | 8 | 8 | 15 | 15 | 15 | 15 | 15 |
| Sodium metasilicate | | — | — | — | — | — | — | — |
| pH of surface treatment solution (20° C.) | | 10.5 | 10.5 | 9.5 | 9.5 | 9.5 | 9.5 | 9.5 |
| Properties | | | | | | | | |
| Salt spray test (test base-material) | ADC12 | ○ | ○ | Δ | Δ | Δ | ○ | ○ |
| | A356.0 | ○ | ○ | ○ | Δ | Δ | ○ | ○ |
| | 1050 | ○ | ○ | ○ | ○ | Δ | ○ | ○ |
| | 2024 | ○ | ○ | Δ | Δ | Δ | ○ | ○ |
| | 3003 | ○ | ○ | ○ | ○ | Δ | ○ | ○ |
| | 4032 | ○ | ○ | Δ | Δ | ○ | ○ | ○ |
| | 5083 | ○ | ○ | ○ | Δ | Δ | ○ | ○ |
| Adhesion of coating paint (test base-material) | ADC12 | ○ | ○ | ○ | ○ | ○ | ○ | ○ |
| | A356.0 | ○ | ○ | ○ | ○ | ○ | ○ | ○ |
| | 1050 | ○ | ○ | ○ | ○ | ○ | ○ | ○ |
| | 2024 | ○ | ○ | ○ | ○ | ○ | ○ | ○ |
| | 3003 | ○ | ○ | ○ | ○ | ○ | ○ | ○ |
| | 4032 | ○ | ○ | ○ | ○ | ○ | ○ | ○ |
| | 5083 | ○ | ○ | ○ | ○ | ○ | ○ | ○ |

TABLE 28

| | | Examples 82-89 | | | | | | | |
|---|---|---|---|---|---|---|---|---|---|
| | | 82 | 83 | 84 | 85 | 86 | 87 | 88 | 89 |
| Condition of heating and pressing | | | | | | | | | |
| temperature/pressure/time (° C./kgf/cm$^2$/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 87 | 87 | 87 | 87 | 87 | 79 | 79 | 79 |
| Manganese dihydrogen phosphate | | 3 | 3 | 3 | 3 | 3 | 5 | 5 | 5 |
| Tetrasodium ethylenediamine tetraacetate | | 5 | 5 | 5 | 5 | 5 | 8 | 8 | 8 |
| Sodium metasilicate | | 5 | 5 | 5 | 5 | 5 | 8 | 8 | 8 |
| pH of surface treatment solution (20° C.) | | 11.0 | 11.0 | 11.0 | 11.0 | 11.0 | 11.2 | 11.2 | 11.2 |
| Properties | | | | | | | | | |
| Salt spray test (test base-material) | ADC12 | Δ | Δ | Δ | ○ | ○ | Δ | Δ | Δ |
| | A356.0 | Δ | Δ | ○ | ○ | Δ | Δ | Δ | Δ |
| | 1050 | Δ | Δ | Δ | ○ | ○ | Δ | Δ | Δ |
| | 2024 | Δ | Δ | Δ | ○ | ○ | Δ | Δ | Δ |
| | 3003 | Δ | Δ | ○ | ○ | Δ | Δ | Δ | Δ |
| | 4032 | Δ | Δ | ○ | ○ | Δ | Δ | Δ | Δ |
| | 5083 | Δ | Δ | ○ | ○ | ○ | Δ | Δ | Δ |
| Adhesion of coating paint (test base-material) | ADC12 | ○ | ○ | ○ | ○ | ○ | ○ | ○ | ○ |
| | A356.0 | ○ | ○ | ○ | ○ | ○ | ○ | ○ | ○ |
| | 1050 | ○ | ○ | ○ | ○ | ○ | ○ | ○ | ○ |
| | 2024 | ○ | ○ | ○ | ○ | ○ | ○ | ○ | ○ |
| | 3003 | ○ | ○ | ○ | ○ | ○ | ○ | ○ | ○ |
| | 4032 | ○ | ○ | ○ | ○ | ○ | ○ | ○ | ○ |
| | 5083 | ○ | ○ | ○ | ○ | ○ | ○ | ○ | ○ |

TABLE 29

| | | Examples 90–96 | | | | | | |
|---|---|---|---|---|---|---|---|---|
| | | 90 | 91 | 92 | 93 | 94 | 95 | 96 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 79 | 79 | 60 | 60 | 60 | 60 | 60 |
| Manganese dihydrogen phosphate | | 5 | 5 | 10 | 10 | 10 | 10 | 10 |
| Tetrasodium ethylenediamine tetraacetate | | 8 | 8 | 15 | 15 | 15 | 15 | 15 |
| Sodium metasilicate | | 8 | 8 | 15 | 15 | 15 | 15 | 15 |
| pH of surface treatment solution (20° C.) | | 11.2 | 11.2 | 11.5 | 11.5 | 11.5 | 11.5 | 11.5 |
| Properties | | | | | | | | |
| Salt spray test (test base-material) | ADC12 | ○ | ○ | Δ | Δ | Δ | ○ | ○ |
| | A356.0 | ○ | ○ | ○ | Δ | Δ | ○ | ○ |
| | 1050 | ○ | ○ | Δ | Δ | Δ | ○ | ○ |
| | 2024 | ○ | ○ | Δ | Δ | ○ | ○ | ○ |
| | 3003 | ○ | ○ | ○ | Δ | Δ | ○ | ○ |
| | 4032 | ○ | ○ | Δ | Δ | ○ | ○ | ○ |
| | 5083 | ○ | ○ | ○ | Δ | Δ | ○ | ○ |
| Adhesion of coating paint (test base-material) | ADC12 | ○ | ○ | ○ | ○ | ○ | ○ | ○ |
| | A356.0 | ○ | ○ | ○ | ○ | ○ | ○ | ○ |
| | 1050 | ○ | ○ | ○ | ○ | ○ | ○ | ○ |
| | 2024 | ○ | ○ | ○ | ○ | ○ | ○ | ○ |
| | 3003 | ○ | ○ | ○ | ○ | ○ | ○ | ○ |
| | 4032 | ○ | ○ | ○ | ○ | ○ | ○ | ○ |
| | 5083 | ○ | ○ | ○ | ○ | ○ | ○ | ○ |

TABLE 30

| | | Examples 97-104 | | | | | | | |
|---|---|---|---|---|---|---|---|---|---|
| | | 97 | 98 | 99 | 100 | 101 | 102 | 103 | 104 |
| Condition of heating and pressing | | | | | | | | | |
| temperature/pressure/time (° C./kgf/cm$^2$/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 93 | 93 | 93 | 93 | 93 | 88 | 88 | 88 |
| Manganous sulfate | | 2 | 2 | 2 | 2 | 2 | 4 | 4 | 4 |
| Disodium hidroxyethilidene diphosphonate | | 5 | 5 | 5 | 5 | 5 | 8 | 8 | 8 |
| Sodium orthosilicate | | — | — | — | — | — | — | — | — |
| pH of surface treatment solution (20° C.) | | 10.5 | 10.5 | 10.5 | 10.5 | 10.5 | 10.0 | 10.0 | 10.0 |
| Properties | | | | | | | | | |
| Salt spray test (test base-material) | ADC12 | Δ | Δ | Δ | ○ | ○ | Δ | Δ | Δ |
| | A356.0 | Δ | Δ | Δ | ○ | ○ | Δ | Δ | Δ |
| | 1050 | Δ | Δ | Δ | ○ | ○ | Δ | Δ | Δ |
| | 2024 | Δ | Δ | Δ | ○ | Δ | Δ | Δ | Δ |
| | 3003 | Δ | Δ | Δ | ○ | ○ | Δ | Δ | Δ |
| | 4032 | Δ | Δ | Δ | ○ | ○ | Δ | Δ | Δ |
| | 5083 | Δ | Δ | Δ | ○ | Δ | Δ | Δ | Δ |
| Adhesion of coating paint (test base-material) | ADC12 | ○ | ○ | ○ | ○ | ○ | ○ | ○ | ○ |
| | A356.0 | ○ | ○ | ○ | ○ | ○ | ○ | ○ | ○ |
| | 1050 | ○ | ○ | ○ | ○ | ○ | ○ | ○ | ○ |
| | 2024 | ○ | ○ | ○ | ○ | ○ | ○ | ○ | ○ |
| | 3003 | ○ | ○ | ○ | ○ | ○ | ○ | ○ | ○ |
| | 4032 | ○ | ○ | ○ | ○ | ○ | ○ | ○ | ○ |
| | 5083 | ○ | ○ | ○ | ○ | ○ | ○ | ○ | ○ |

TABLE 31

| | | Examples 105-111 | | | | | | |
|---|---|---|---|---|---|---|---|---|
| | | 105 | 106 | 107 | 108 | 109 | 110 | 111 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 88 | 88 | 75 | 75 | 75 | 75 | 75 |
| Manganous sulfate | | 4 | 4 | 10 | 10 | 10 | 10 | 10 |
| Disodium hidroxyethilidene diphosphonate | | 8 | 8 | 15 | 15 | 15 | 15 | 15 |
| Sodium orthosilicate | | — | — | — | — | — | — | — |
| pH of surface treatment solution (20° C.) | | 10.0 | 10.0 | 9.5 | 9.5 | 9.5 | 9.5 | 9.5 |
| Properties | | | | | | | | |
| Salt spray test (test base-material) | ADC12 | ○ | ○ | Δ | Δ | Δ | ○ | ○ |
| | A356.0 | ○ | ○ | Δ | Δ | Δ | ○ | ○ |
| | 1050 | ○ | ○ | Δ | Δ | Δ | ○ | ○ |
| | 2024 | ○ | ○ | Δ | Δ | Δ | ○ | ○ |
| | 3003 | ○ | ○ | Δ | Δ | Δ | ○ | ○ |
| | 4032 | ○ | ○ | Δ | Δ | Δ | ○ | ○ |
| | 5083 | ○ | ○ | ○ | Δ | Δ | ○ | ○ |
| Adhesion of coating paint (test base-material) | ADC12 | ○ | ○ | ○ | ○ | ○ | ○ | ○ |
| | A356.0 | ○ | ○ | ○ | ○ | ○ | ○ | ○ |
| | 1050 | ○ | ○ | ○ | ○ | ○ | ○ | ○ |
| | 2024 | ○ | ○ | ○ | ○ | ○ | ○ | ○ |
| | 3003 | ○ | ○ | ○ | ○ | ○ | ○ | ○ |
| | 4032 | ○ | ○ | ○ | ○ | ○ | ○ | ○ |
| | 5083 | ○ | ○ | ○ | ○ | ○ | ○ | ○ |

TABLE 32

| | | Examples 112-119 | | | | | | | |
|---|---|---|---|---|---|---|---|---|---|
| | | 112 | 113 | 114 | 115 | 116 | 117 | 118 | 119 |
| Condition of heating and pressing | | | | | | | | | |
| temperature/pressure/time (° C./kgf/cm$^2$/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 88 | 88 | 88 | 88 | 88 | 80 | 80 | 80 |
| Manganous sulfate | | 2 | 2 | 2 | 2 | 2 | 4 | 4 | 4 |
| Disodium hidroxyethilidene diphosphonate | | 5 | 5 | 5 | 5 | 5 | 8 | 8 | 8 |
| Sodium orthosilicate | | 5 | 5 | 5 | 5 | 5 | 8 | 8 | 8 |
| pH of surface treatment solution (20° C.) | | 11.0 | 11.0 | 11.0 | 11.0 | 11.0 | 11.2 | 11.2 | 11.2 |
| Properties | | | | | | | | | |
| Salt spray test (test base-material) | ADC12 | Δ | Δ | Δ | ○ | ○ | Δ | Δ | Δ |
| | A356.0 | Δ | Δ | Δ | ○ | Δ | Δ | Δ | Δ |
| | 1050 | Δ | Δ | Δ | ○ | ○ | Δ | Δ | Δ |
| | 2024 | Δ | Δ | Δ | ○ | Δ | Δ | Δ | Δ |
| | 3003 | Δ | Δ | Δ | ○ | Δ | Δ | Δ | Δ |
| | 4032 | Δ | Δ | Δ | ○ | Δ | Δ | Δ | Δ |
| | 5083 | Δ | Δ | Δ | ○ | ○ | Δ | Δ | Δ |
| Adhesion of coating paint (test base-material) | ADC12 | ○ | ○ | ○ | ○ | ○ | ○ | ○ | ○ |
| | A356.0 | ○ | ○ | ○ | ○ | ○ | ○ | ○ | ○ |
| | 1050 | ○ | ○ | ○ | ○ | ○ | ○ | ○ | ○ |
| | 2024 | ○ | ○ | ○ | ○ | ○ | ○ | ○ | ○ |
| | 3003 | ○ | ○ | ○ | ○ | ○ | ○ | ○ | ○ |
| | 4032 | ○ | ○ | ○ | ○ | ○ | ○ | ○ | ○ |
| | 5083 | ○ | ○ | ○ | ○ | ○ | ○ | ○ | ○ |

TABLE 33

| | | Examples 120-126 | | | | | | |
|---|---|---|---|---|---|---|---|---|
| | | 120 | 121 | 122 | 123 | 124 | 125 | 126 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 80 | 80 | 60 | 60 | 60 | 60 | 60 |
| Manganous sulfate | | 4 | 4 | 10 | 10 | 10 | 10 | 10 |
| Disodium hidroxyethilidene diphosphonate | | 8 | 8 | 15 | 15 | 15 | 15 | 15 |
| Sodium orthosilicate | | 8 | 8 | 15 | 15 | 15 | 15 | • 15 |
| pH of surface treatment solution (20° C.) | | 11.2 | 11.2 | 11.5 | 11.5 | 11.5 | 11.5 | 11.5 |
| Properties | | | | | | | | |
| Salt spray test (test base-material) | ADC12 | ○ | ○ | Δ | Δ | Δ | ○ | ○ |
| | A356.0 | ○ | ○ | Δ | Δ | Δ | ○ | ○ |
| | 1050 | ○ | ○ | Δ | Δ | Δ | ○ | ○ |
| | 2024 | ○ | ○ | Δ | Δ | Δ | ○ | ○ |
| | 3003 | ○ | ○ | Δ | Δ | Δ | ○ | ○ |
| | 4032 | ○ | ○ | Δ | Δ | Δ | ○ | ○ |
| | 5083 | ○ | ○ | ○ | Δ | Δ | ○ | ○ |
| Adhesion of coating paint (test base-material) | ADC12 | ○ | ○ | ○ | ○ | ○ | ○ | ○ |
| | A356.0 | ○ | ○ | ○ | ○ | ○ | ○ | ○ |
| | 1050 | ○ | ○ | ○ | ○ | ○ | ○ | ○ |
| | 2024 | ○ | ○ | ○ | ○ | ○ | ○ | ○ |
| | 3003 | ○ | ○ | ○ | ○ | ○ | ○ | ○ |
| | 4032 | ○ | ○ | ○ | ○ | ○ | ○ | ○ |
| | 5083 | ○ | ○ | ○ | ○ | ○ | ○ | ○ |

TABLE 34

| | | Examples 127-132 | | | | | |
|---|---|---|---|---|---|---|---|
| | | 127 | 128 | 129 | 130 | 131 | 132 |
| Condition of heating and pressing | | | | | | | |
| temperature/pressure/time (° C./kgf/cm$^2$/min) | | 150/4.5/30 | 150/4.5/30 | 150/4.5/30 | 150/4.5/30 | 150/4.5/30 | 150/4.5/30 |
| Concentration of surface treatment agent (%) | | | | | | | |
| Water | | 89 | 82 | 65 | 84 | 74 | 55 |
| Manganous sulfate | | 3 | 5 | 10 | 3 | 5 | 10 |
| Disodium hidroxyethilidene diphosphonate | | 5 | 8 | 15 | 5 | 8 | 15 |
| Sodium orthosilicate | | — | — | — | 5 | 8 | 10 |
| Sodium molybdate | | 3 | 5 | 10 | 3 | 5 | 10 |
| pH of surface treatment solution (20° C.) | | 11.2 | 10.0 | 10.5 | 9.5 | 11.0 | 11.2 |
| Properties | | | | | | | |
| Salt spray test (test base-material) | ADC12 | ○ | ○ | ○ | ○ | ○ | ○ |
| | A356.0 | ○ | ○ | ○ | ○ | ○ | ○ |
| | 1050 | ○ | ○ | ○ | ○ | ○ | ○ |
| | 2024 | ○ | ○ | ○ | ○ | ○ | ○ |
| | 3003 | ○ | ○ | ○ | ○ | ○ | ○ |
| | 4032 | ○ | ○ | ○ | ○ | ○ | ○ |
| | 5083 | ○ | ○ | ○ | ○ | ○ | ○ |
| Adhesion of coating paint (test base-material) | ADC12 | ○ | ○ | ○ | ○ | ○ | ○ |
| | A356.0 | ○ | ○ | ○ | ○ | ○ | ○ |
| | 1050 | ○ | ○ | ○ | ○ | ○ | ○ |
| | 2024 | ○ | ○ | ○ | ○ | ○ | ○ |
| | 3003 | ○ | ○ | ○ | ○ | ○ | ○ |
| | 4032 | ○ | ○ | ○ | ○ | ○ | ○ |
| | 5083 | ○ | ○ | ○ | ○ | ○ | ○ |

COMPARATIVE EXAMPLES 92-182

The treatment agents used as the surface treatment liquids are identical in type to those of Examples 67-132. The surface treatment methods which are not considered to be adequate in terms of condition of heating under pressure or concentration or pH of the treatment agents are cited as Comparative Examples. The conditions of heating under pressure, concentration of the treatment agents and pH of the treatment liquids, and their properties (evaluation results) are shown in TABLES 35 to 46.

TABLE 35

| | | Comparative Examples 92-99 | | | | | | | |
|---|---|---|---|---|---|---|---|---|---|
| | | 92 | 93 | 94 | 95 | 96 | 97 | 98 | 99 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |
| Concentration of surface treatment agent (%) | | | | | | | | | |
| Water | | 92 | 92 | 92 | 92 | 87 | 87 | 87 | 87 |
| Manganese dihydrogen phosphate | | 3 | 3 | 3 | 3 | 5 | 5 | 5 | 5 |
| Tetrasodium ethylenediamine tetraacetate | | 5 | 5 | 5 | 5 | 8 | 8 | 8 | 8 |
| Sodium metasilicate | | — | — | — | — | — | — | — | — |
| pH of surface treatment solution (20° C.) | | 10.0 | 10.0 | 10.0 | 10.0 | 10.5 | 10.5 | 10.5 | 10.5 |
| Properties | | | | | | | | | |
| Salt spray test (test base-material) | ADC12 | X | X | X | X | X | X | X | X |
| | A356.0 | X | X | X | X | X | X | X | X |
| | 1050 | X | X | X | X | X | X | X | X |
| | 2024 | X | X | X | X | X | X | X | X |
| | 3003 | X | X | X | X | X | X | X | X |
| | 4032 | X | X | X | X | X | X | X | X |
| | 5083 | X | X | X | X | X | X | X | X |

TABLE 35-continued

| | | Comparative Examples 92-99 | | | | | | | |
|---|---|---|---|---|---|---|---|---|---|
| | | 92 | 93 | 94 | 95 | 96 | 97 | 98 | 99 |
| Adhesion of coating paint (test base-material) | ADC12 | X | X | X | X | X | X | X | X |
| | A356.0 | X | X | X | X | X | X | X | X |
| | 1050 | X | X | X | X | X | X | X | X |
| | 2024 | X | X | X | X | X | X | X | X |
| | 3003 | X | X | X | X | X | X | X | X |
| | 4032 | X | X | X | X | X | X | X | X |
| | 5083 | X | X | X | X | X | X | X | X |

TABLE 36

| | | Comparative Examples 100-107 | | | | | | | |
|---|---|---|---|---|---|---|---|---|---|
| | | 100 | 101 | 102 | 103 | 104 | 105 | 106 | 107 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 75 | 75 | 75 | 75 | 65 | 65 | 65 | 65 |
| Manganese dihydrogen phosphate | | 10 | 10 | 10 | 10 | 15 | 15 | 15 | 15 |
| Tetrasodium ethylenediamine tetraacetate | | 15 | 15 | 15 | 15 | 20 | 20 | 20 | 20 |
| Sodium metasilicate | | — | — | — | — | — | — | — | — |
| pH of surface treatment solution (20° C.) | | 9.5 | 9.5 | 9.5 | 9.5 | 9.5 | 9.5 | 9.5 | 9.5 |
| Properties | | | | | | | | | |
| Salt spray test (test base-material) | ADC12 | X | X | X | X | Δ | ○ | Δ | ○ |
| | A356.0 | X | X | X | X | Δ | Δ | Δ | ○ |
| | 1050 | X | X | X | X | Δ | Δ | Δ | ○ |
| | 2024 | X | X | X | X | Δ | X | X | Δ |
| | 3003 | X | X | X | X | Δ | Δ | Δ | ○ |
| | 4032 | X | X | X | X | Δ | Δ | Δ | Δ |
| | 5083 | X | X | X | X | Δ | Δ | Δ | ○ |
| Adhesion of coating paint (test base-material) | ADC12 | X | X | X | X | X | X | X | X |
| | A356.0 | X | X | X | X | X | X | X | X |
| | 1050 | X | X | X | X | X | X | X | X |
| | 2024 | X | X | X | X | X | X | X | X |
| | 3003 | X | X | X | X | X | X | X | X |
| | 4032 | X | X | X | X | X | X | X | X |
| | 5083 | X | X | X | X | X | X | X | X |

TABLE 37

| | | Comparative Examples 108-115 | | | | | | | |
|---|---|---|---|---|---|---|---|---|---|
| | | 108 | 109 | 110 | 111 | 112 | 113 | 114 | 115 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |
| Concentration of surface treatment agent (%) | | | | | | | | | |
| Water | | 87 | 87 | 87 | 87 | 79 | 79 | 79 | 79 |
| Manganese dihydrogen phosphate | | 3 | 3 | 3 | 3 | 5 | 5 | 5 | 5 |
| Tetrasodium ethylenediamine tetraacetate | | 5 | 5 | 5 | 5 | 8 | 8 | 8 | 8 |
| Sodium metasilicate | | 5 | 5 | 5 | 5 | 8 | 8 | 8 | 8 |
| pH of surface treatment solution (20° C.) | | 11.0 | 11.0 | 11.0 | 11.0 | 11.2 | 11.2 | 11.2 | 11.2 |
| Properties | | | | | | | | | |
| Salt spray test | ADC12 | X | X | X | X | X | X | X | X |

TABLE 37-continued

| | | Comparative Examples 108-115 | | | | | | | |
|---|---|---|---|---|---|---|---|---|---|
| | | 108 | 109 | 110 | 111 | 112 | 113 | 114 | 115 |
| (test base-material) | A356.0 | X | X | X | X | X | X | X | X |
| | 1050 | X | X | X | X | X | X | X | X |
| | 2024 | X | X | X | X | X | X | X | X |
| | 3003 | X | X | X | X | X | X | X | X |
| | 4032 | X | X | X | X | X | X | X | X |
| | 5083 | X | X | X | X | X | X | X | X |
| Adhesion of coating | ADC12 | X | X | X | X | X | X | X | X |
| paint | A356.0 | X | X | X | X | X | X | X | X |
| (test base-material) | 1050 | X | X | X | X | X | X | X | X |
| | 2024 | X | X | X | X | X | X | X | X |
| | 3003 | X | X | X | X | X | X | X | X |
| | 4032 | X | X | X | X | X | X | X | X |
| | 5083 | X | X | X | X | X | X | X | X |

TABLE 38

| | | Comparative Examples 116-123 | | | | | | | |
|---|---|---|---|---|---|---|---|---|---|
| | | 116 | 117 | 118 | 119 | 120 | 121 | 122 | 123 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 60 | 60 | 60 | 60 | 45 | 45 | 45 | 45 |
| Manganese dihydrogen phosphate | | 10 | 10 | 10 | 10 | 15 | 15 | 15 | 15 |
| Tetrasodium ethylenediamine tetraacetate | | 15 | 15 | 15 | 15 | 20 | 20 | 20 | 20 |
| Sodium metasilicate | | 15 | 15 | 15 | 15 | 20 | 20 | 20 | 20 |
| pH of surface treatment solution (20° C.) | | 11.5 | 11.5 | 11.5 | 11.5 | 11.7 | 11.7 | 11.7 | 11.7 |
| Properties | | | | | | | | | |
| Salt spray test | ADC12 | X | X | X | X | Δ | ○ | ○ | ○ |
| (test base-material) | A356.0 | X | X | X | X | Δ | ○ | Δ | Δ |
| | 1050 | X | X | X | X | Δ | ○ | ○ | Δ |
| | 2024 | X | X | X | X | Δ | Δ | ○ | Δ |
| | 3003 | X | X | X | X | Δ | Δ | Δ | Δ |
| | 4032 | X | X | X | X | Δ | Δ | Δ | Δ |
| | 5083 | X | X | X | X | Δ | ○ | ○ | Δ |
| Adhesion of coating | ADC12 | X | X | X | X | X | X | X | X |
| paint | A356.0 | X | X | X | X | X | X | X | X |
| (test base-material) | 1050 | X | X | X | X | X | X | X | X |
| | 2024 | X | X | X | X | X | X | X | X |
| | 3003 | X | X | X | X | X | X | X | X |
| | 4032 | X | X | X | X | X | X | X | X |
| | 5083 | X | X | X | X | X | X | X | X |

TABLE 39

| | Comparative Examples 124-131 | | | | | | | |
|---|---|---|---|---|---|---|---|---|
| | 124 | 125 | 126 | 127 | 128 | 129 | 130 | 131 |
| Condition of heating and pressing | | | | | | | | |
| temperature/pressure/time (° C./kgf/cm$^2$/min) | 30/0 /60 | 30/0.2 /30 | 30/0.2 /60 | 200/12 /0.5 | 30/0 /60 | 30/0.2 /30 | 30/0.2 /60 | 200/12 /0.5 |
| Concentration of surface treatment agent (%) | | | | | | | | |
| Water | 93 | 93 | 93 | 93 | 88 | 88 | 88 | 88 |
| Manganous sulfate | 2 | 2 | 2 | 2 | 4 | 4 | 4 | 4 |
| Disodium hidroxyethilidene diphosphonate | 5 | 5 | 5 | 5 | 8 | 8 | 8 | 8 |

TABLE 39-continued

| | | Comparative Examples 124-131 | | | | | | | |
|---|---|---|---|---|---|---|---|---|---|
| | | 124 | 125 | 126 | 127 | 128 | 129 | 130 | 131 |
| Sodium orthosilicate | | — | — | — | — | — | — | — | — |
| pH of surface treatment solution (20° C.) | | 10.5 | 10.5 | 10.5 | 10.5 | 10.0 | 10.0 | 10.0 | 10.0 |
| Properties | | | | | | | | | |
| Salt spray test | ADC12 | X | X | X | X | X | X | X | X |
| (test base-material) | A356.0 | X | X | X | X | X | X | X | X |
| | 1050 | X | X | X | X | X | X | X | X |
| | 2024 | X | X | X | X | X | X | X | X |
| | 3003 | X | X | X | X | X | X | X | X |
| | 4032 | X | X | X | X | X | X | X | X |
| | 5083 | X | X | X | X | X | X | X | X |
| Adhesion of coating | ADC12 | X | X | X | X | X | X | X | X |
| paint | A356.0 | X | X | X | X | X | X | X | X |
| (test base-material) | 1050 | X | X | X | X | X | X | X | X |
| | 2024 | X | X | X | X | X | X | X | X |
| | 3003 | X | X | X | X | X | X | X | X |
| | 4032 | X | X | X | X | X | X | X | X |
| | 5083 | X | X | X | X | X | X | X | X |

TABLE 40

| | | Comparative Examples 132-139 | | | | | | | |
|---|---|---|---|---|---|---|---|---|---|
| | | 132 | 133 | 134 | 135 | 136 | 137 | 138 | 139 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 75 | 75 | 75 | 75 | 65 | 65 | 65 | 65 |
| Manganous sulfate | | 10 | 10 | 10 | 10 | 15 | 15 | 15 | 15 |
| Disodium hidroxyethilidene diphosphonate | | 15 | 15 | 15 | 15 | 20 | 20 | 20 | 20 |
| Sodium orthosilicate | | — | — | — | — | — | — | — | — |
| pH of surface treatment solution (20° C.) | | 9.5 | 9.5 | 9.5 | 9.5 | 9.5 | 9.5 | 9.5 | 9.5 |
| Properties | | | | | | | | | |
| Salt spray test | ADC12 | X | X | X | X | Δ | ○ | Δ | ○ |
| (test base-material) | A356.0 | X | X | X | X | Δ | Δ | Δ | ○ |
| | 1050 | X | X | X | X | Δ | Δ | Δ | ○ |
| | 2024 | X | X | X | X | Δ | Δ | Δ | Δ |
| | 3003 | X | X | X | X | Δ | Δ | Δ | ○ |
| | 4032 | X | X | X | X | Δ | Δ | Δ | Δ |
| | 5083 | X | X | X | X | Δ | Δ | Δ | ○ |
| Adhesion of coating | ADC12 | X | X | X | X | X | X | X | X |
| paint | A356.0 | X | X | X | X | X | X | X | X |
| (test base-material) | 1050 | X | X | X | X | X | X | X | X |
| | 2024 | X | X | X | X | X | X | X | X |
| | 3003 | X | X | X | X | X | X | X | X |
| | 4032 | X | X | X | X | X | X | X | X |
| | 5083 | X | X | X | X | X | X | X | X |

TABLE 41

| | | Comparative Examples 140-147 | | | | | | | |
|---|---|---|---|---|---|---|---|---|---|
| | | 140 | 141 | 142 | 143 | 144 | 145 | 146 | 147 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |

TABLE 41-continued

| | | Comparative Examples 140-147 | | | | | | | |
|---|---|---|---|---|---|---|---|---|---|
| | | 140 | 141 | 142 | 143 | 144 | 145 | 146 | 147 |
| Concentration of surface treatment agent (%) | | | | | | | | | |
| Water | | 88 | 88 | 88 | 88 | 80 | 80 | 80 | 80 |
| Manganous sulfate | | 2 | 2 | 2 | 2 | 4 | 4 | 4 | 4 |
| Disodium hidroxyethilidene diphosphonate | | 5 | 5 | 5 | 5 | 8 | 8 | 8 | 8 |
| Sodium orthosilicate | | 5 | 5 | 5 | 5 | 8 | 8 | 8 | 8 |
| pH of surface treatment solution (20° C.) | | 11.0 | 11.0 | 11.0 | 11.0 | 11.2 | 11.2 | 11.2 | 11.2 |
| Properties | | | | | | | | | |
| Salt spray test (test base-material) | ADC12 | X | X | X | X | X | X | X | X |
| | A356.0 | X | X | X | X | X | X | X | X |
| | 1050 | X | X | X | X | X | X | X | X |
| | 2024 | X | X | X | X | X | X | X | X |
| | 3003 | X | X | X | X | X | X | X | X |
| | 4032 | X | X | X | X | X | X | X | X |
| | 5083 | X | X | X | X | X | X | X | X |
| Adhesion of coating paint (test base-material) | ADC12 | X | X | X | X | X | X | X | X |
| | A356.0 | X | X | X | X | X | X | X | X |
| | 1050 | X | X | X | X | X | X | X | X |
| | 2024 | X | X | X | X | X | X | X | X |
| | 3003 | X | X | X | X | X | X | X | X |
| | 4032 | X | X | X | X | X | X | X | X |
| | 5083 | X | X | X | X | X | X | X | X |

TABLE 42

| | | Comparative Examples 148-155 | | | | | | | |
|---|---|---|---|---|---|---|---|---|---|
| | | 148 | 149 | 150 | 151 | 152 | 153 | 154 | 155 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 60 | 60 | 60 | 60 | 45 | 45 | 45 | 45 |
| Manganous sulfate | | 10 | 10 | 10 | 10 | 15 | 15 | 15 | 15 |
| Disodium hidroxyethilidene diphosphonate | | 15 | 15 | 15 | 15 | 20 | 20 | 20 | 20 |
| Sodium orthosilicate | | 15 | 15 | 15 | 15 | 20 | 20 | 20 | 20 |
| pH of surface treatment solution (20° C.) | | 11.5 | 11.5 | 11.5 | 11.5 | 11.5 | 11.8 | 11.8 | 11.8 |
| Properties | | | | | | | | | |
| Salt spray test (test base-material) | ADC12 | X | X | X | X | Δ | ○ | ○ | ○ |
| | A356.0 | X | X | X | X | Δ | ○ | Δ | Δ |
| | 1050 | X | X | X | X | Δ | ○ | ○ | Δ |
| | 2024 | X | X | X | X | Δ | Δ | Δ | Δ |
| | 3003 | X | X | X | X | Δ | Δ | Δ | Δ |
| | 4032 | X | X | X | X | Δ | Δ | Δ | Δ |
| | 5083 | X | X | X | X | Δ | ○ | ○ | Δ |
| Adhesion of coating paint (test base-material) | ADC12 | X | X | X | X | X | X | X | X |
| | A356.0 | X | X | X | X | X | X | X | X |
| | 1050 | X | X | X | X | X | X | X | X |
| | 2024 | X | X | X | X | X | X | X | X |
| | 3003 | X | X | X | X | X | X | X | X |
| | 4032 | X | X | X | X | X | X | X | X |
| | 5083 | X | X | X | X | X | X | X | X |

TABLE 43

| | | Comparative Examples 156-161 | | | | | |
|---|---|---|---|---|---|---|---|
| | | 156 | 157 | 158 | 159 | 160 | 161 |
| Condition of heating and pressing | | | | | | | |
| temperature/pressure/time (° C./kgf/cm$^2$/min) | | 30/0/60 | 30/0/60 | 30/0/60 | 30/0/60 | 30/0/60 | 30/0/60 |
| Concentration of surface treatment agent (%) | | | | | | | |
| Water | | 89 | 89 | 82 | 82 | 65 | 65 |
| Manganese dihydrogen phosphate | | 3 | 3 | 5 | 5 | 10 | 10 |
| Tetrasodium ethylenediamine tetraacetate | | 5 | 5 | 8 | 8 | 15 | 15 |
| Sodium molybdate | | 3 | 3 | 5 | 5 | 10 | 10 |
| pH of surface treatment solution (20° C.) | | 10.0 | 10.0 | 10.5 | 10.5 | 9.5 | 9.5 |
| Properties | | | | | | | |
| Salt spray test (test base-material) | ADC12 | X | X | X | X | X | X |
| | A356.0 | X | X | X | X | X | X |
| | 1050 | X | X | X | X | X | X |
| | 2024 | X | X | X | X | X | X |
| | 3003 | X | X | X | X | X | X |
| | 4032 | X | X | X | X | X | X |
| | 5083 | X | X | X | X | X | X |
| Adhesion of coating paint (test base-material) | ADC12 | X | X | X | X | X | X |
| | A356.0 | X | X | X | X | X | X |
| | 1050 | X | X | X | X | X | X |
| | 2024 | X | X | X | X | X | X |
| | 3003 | X | X | X | X | X | X |
| | 4032 | X | X | X | X | X | X |
| | 5083 | X | X | X | X | X | X |

TABLE 44

| | | Comparative Examples 162-168 | | | | | | |
|---|---|---|---|---|---|---|---|---|
| | | 162 | 163 | 164 | 165 | 166 | 167 | 168 |
| Condition of heating and pressing | | | | | | | | |
| temperature/pressure/time (° C./kgf/cm$^2$/min) | | 30/0/60 | 30/0/60 | 30/0/60 | 30/0/60 | 30/0/60 | 30/0/60 | 150/4.5/30 |
| Concentration of surface treatment agent (%) | | | | | | | | |
| Water | | 84 | 84 | 74 | 74 | 55 | 55 | 30 |
| Manganese dihydrogen phosphate | | 3 | 3 | 5 | 5 | 10 | 10 | 15 |
| Tetrasodium ethylenediamine tetraacetate | | 5 | 5 | 8 | 8 | 15 | 15 | 20 |
| Sodium metasilicate | | 5 | 5 | 8 | 8 | 10 | 10 | 20 |
| Sodium molybdate | | 3 | 3 | 5 | 5 | 10 | 10 | 15 |
| pH of surface treatment solution (20° C.) | | 11.0 | 11.0 | 11.2 | 11.2 | 11.5 | 11.5 | 11.7 |
| Properties | | | | | | | | |
| Salt spray test (test base-material) | ADC12 | X | X | X | X | X | X | ○ |
| | A356.0 | X | X | X | X | X | X | ○ |
| | 1050 | X | X | X | X | X | X | ○ |
| | 2024 | X | X | X | X | X | X | ○ |
| | 3003 | X | X | X | X | X | X | ○ |
| | 4032 | X | X | X | X | X | x | ○ |
| | 5083 | X | X | X | X | X | X | ○ |
| Adhesion of coating paint (test base-material) | ADC12 | X | X | X | X | X | X | X |
| | A356.0 | X | X | X | X | X | X | X |
| | 1050 | X | X | X | X | X | X | X |
| | 2024 | X | X | X | X | X | X | X |
| | 3003 | X | X | X | X | X | X | X |
| | 4032 | X | X | X | X | X | X | X |
| | 5083 | X | X | X | X | X | X | X |

TABLE 45

| | Comparative Examples 169-176 | | | | | | | |
|---|---|---|---|---|---|---|---|---|
| | 169 | 170 | 171 | 172 | 173 | 174 | 175 | 176 |
| Condition of heating and pressing | | | | | | | | |
| temperature/pressure/time (° C./kgf/cm$^2$/min) | 150/4.5/30 | 150/4.5/30 | 150/4.5/30 | 150/4.5/30 | 150/4.5/30 | 150/4.5/30 | 150/4.5/30 | 150/4.5/30 |
| Concentration of surface treatment agent (%) | | | | | | | | |
| Water | 92 | 87 | 75 | 90 | 83 | 67 | 91 | 89 |
| Manganese dihydrogen phosphate | 3 | 5 | 10 | 3 | 5 | 10 | 3 | 3 |
| Tetrasodium ethylenediamine tetraacetate | 5 | 8 | 15 | 5 | 8 | 15 | 3 | 3 |
| Sodium metasilicate | — | — | — | 2 | 4 | 8 | — | 2 |
| Sodium molybdate | — | — | — | — | — | — | 3 | 3 |
| pH of surface treatment solution (20° C.) | 5.0 | 5.0 | 5.0 | 8.0 | 8.0 | 8.0 | 6.0 | 7.0 |
| Change in dimension and surface profile of test piece (test base-material) | | | | | | | | |
| ADC12 | Change of dimension and corrosion of surface are found | | | | | | | |
| A356.0 | Change of dimension and corrosion of surface are found | | | | | | | |
| 1050 | Change of dimension and corrosion of surface are found | | | | | | | |
| 2024 | Change of dimension and corrosion of surface are found | | | | | | | |
| 3003 | Change of dimension and corrosion of surface are found | | | | | | | |
| 4032 | Change of dimension and corrosion of surface are found | | | | | | | |
| 5083 | Change of dimension and corrosion of surface are found | | | | | | | |

TABLE 46

| | Comparative Examples 177-182 | | | | | |
|---|---|---|---|---|---|---|
| | 177 | 178 | 179 | 180 | 181 | 182 |
| Condition of heating and pressing | | | | | | |
| temperature/pressure/time (° C./kgf/cm$^2$/min) | 150/4.5/30 | 150/4.5/30 | 150/4.5/30 | 150/4.5/30 | 150/4.5/30 | 150/4.5/30 |
| Concentration of surface treatment agent (%) | | | | | | |
| Water | 94 | 90 | 80 | 92 | 86 | 72 |
| Manganous sulfate | 3 | 5 | 10 | 3 | 5 | 10 |
| Disodium hidroxyethilidene diphosphonate | 3 | 5 | 10 | 3 | 5 | 10 |
| Sodium orthosilicate | — | — | — | 2 | 4 | 8 |
| pH of surface treatment solution (20° C.) | 5.0 | 5.0 | 5.0 | 8.0 | 8.0 | 8.0 |
| Change in dimension and surface profile of test piece (test base-material) | | | | | | |
| ADC12 | Change of dimension and corrosion of surface are found | | | | | |
| A356.0 | Change of dimension and corrosion of surface are found | | | | | |
| 1050 | Change of dimension and corrosion of surface are found | | | | | |
| 2024 | Change of dimension and corrosion of surface are found | | | | | |
| 3003 | Change of dimension and corrosion of surface are found | | | | | |
| 4032 | Change of dimension and corrosion of surface are found | | | | | |
| 5083 | Change of dimension and corrosion of surface are found | | | | | |

From comparison between Examples 67-132 of TABLES 26-34 and Comparative Examples 92-182 of TABLES 35-46 it was found that all Examples 67-132 were acceptable in that the rust resisting time in the salt spray test was 24 hours or more, as well as in adhesion of the paint. In contrast to this, it was found therefrom that Comparative Examples 92-168 were all rejected in terms of adhesion of the paint, and Comparative Examples 169-182 were all less than 9 in pH of the surface treatment liquid, such that the change (reduction) of dimension resulting from corrosion or the corrosion of surface was found.

Following facts were found from the salt spray test results of Comparative Examples.

Comparative Examples 92-94, 96-98, 100-102, 108-110, 112-114, 116-118, 124-126, 128-130, 132-134, 140-142, 144-146, 148-150 and 156-167 were rejected. This is because the surface treatment conditions were not fulfilled in that the heating temperature was as low as 30° C. (less than 35° C.), the pressure was zero or 0.2 kgf/cm$^2$, etc. Comparative Examples 95, 99, 103, 111, 115, 119, 127, 131, 135, 143, 147 and 151 were rejected. This is because although the heating temperature was as high as 200° C. and also the pressure was as high as 12 kgf/cm$^2$, the processing time was as significantly short as 0.5 min. (less than one minute). Comparative Examples 105-107, 120-123, 136-139, 153-155 and 168 were evaluated to be acceptable in the salt spray test, despite of being rejected in adhesion of the paint. This is probably because the surface treatment conditions were adequate.

Comparative Examples 105-107, 120-123, 136-139, 152-155 and 168 were rejected in terms of adhesion of the paint, despite of being adequate in the surface treatment conditions. This is due to the concentration of components of the surface treatment liquid. In Comparative Examples 105-107, the manganese dihydrogen phosphate concentration was in excess of 10% and the ethylenediamine tetrasodium tetraacetate concentration was in excess of 15%. In Comparative Examples 120-123, the sodium metasilicate concentration was in excess of 15%, in addition to those concentrations. This probably caused the residual of the surface treatment liquid to adhere to the surface of the test pieces, resulting in the rejection. In Comparative Examples 136-139, the manganous sulfate concentration was in excess of 10% and the hydroxyethilidene disodium diphosphonate concentration was in excess of 15%. In Comparative Examples 152-155, the sodium orthosilicate concentration was in excess of 15%, in addition to those concentrations. In Comparative Example 168, 15% of sodium molybdate was added. This probably caused the residual of the surface treatment liquid to adhere to the surface of the test pieces, resulting in the rejection.

No substantial difference was found in the salt spray test results between Examples using the aqueous solution to which no silicate or molybdenum compound was added (Examples 67-81 and 97-111) and Examples using the aqueous solution to which silicate or molybdenum compound was added (Examples 82-96 and 112-132).

(3) Third, Reference will Made to the Zinc Alloy.

(Test Piece)

The evaluation test base-materials of the zinc alloys used were ASTM standard products: AC41A (Al: 3.5-4.3%; Cu: 0.75-1.25%, Mg: 0.02-0.06% and Residual Zn-size 3×25×50 mm); and AG 40A (Al: 3.5-4.3%; Cu: not more than 0.25%, Mg: 0.02-0.06% and Residual Zn-size 3×25×50 mm), both of which were not subjected to the pre-cleaning process using acid, alkali, or organic solvent. It is to be noted that the both base materials are cast metal materials.

The surface treatment of the zinc alloys was made in the same manner as in that of the magnesium alloys.

(Testing and Evaluation Method)

The corrosion resistance of the surface treatment coating thus formed was visually observed on whether the white rust occurs on the surface of the test base-material in accordance with JIS Z 2371 (salt spray test method) and the time required for the white rust to occur (hereinafter it is referred to as "rust resisting time" was measured in the same manner as in that of the magnesium alloys.

The evaluation was classified into three stages with reference to the judgment standard shown in TABLE 47 (which corresponds to TABLES 1 and 24). The rust resisting time of less than 24 hours that falls under the category "x" means that it is likely that some problem may be caused at least in practice. The rust resisting time of 24 hours or more that falls under the category "Δ" or "○" means that it is likely that no problem may be caused at least in practice. When it takes longer before the white rust occurs, the surface treatment coating is considered to be excellent in rust resistance.

TABLE 47

| | |
|---|---|
| X | Less than 24 hours |
| Δ | 24 hours or more to less than 100 hours |
| ○ | 100 hours or moe |

Another corrosion resistance evaluation method of "High-temperature-and-high-moisture test" was conducted under the condition of 85° C.×85% RH. The surface treatment coating formed was visually observed on whether the white rust occurs on the surface of the test base-material (at its flat surface portions and edge portions) and the time required for the white rust to occur (hereinafter it is referred to as "rust resisting time" was measured. Then, the evaluation was classified into three stages with reference to the judgment standard shown in TABLE 48. The rust resisting time of less than 24 hours that falls under the category "x" means that it is likely that some problem may be caused at least in practice. The rust resisting time of 24 hours or more that falls under the category "Δ" or "○" means that it is likely that no problem may be caused at least in practice. When it takes longer before the white rust occurs, the surface treatment coating is considered to be excellent in rust resistance.

TABLE 48

| | |
|---|---|
| X | Less than 24 hours |
| Δ | 24 hours or more to less than 200 hours |
| ○ | 200 hours or more |

EXAMPLES 141-192

In these examples, the same surface treatment liquids as those in the Examples using the magnesium alloys were used for the surface treatment of the zinc alloy specimens. The conditions of heating under pressure, concentration of the treatment agents, pH of the treatment liquids, and their properties (evaluation results) are shown in TABLES 49 to 56.

TABLE 49

| | | Examples 133-140 | | | | | | | |
|---|---|---|---|---|---|---|---|---|---|
| | | 133 | 134 | 135 | 136 | 137 | 138 | 139 | 140 |
| Condition of heating and pressing | | | | | | | | | |
| temperature/pressure/time (° C./kgf/cm$^2$/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 92 | 92 | 92 | 92 | 92 | 87 | 87 | 87 |
| Manganese dihydrogen phosphate | | 3 | 3 | 3 | 3 | 3 | 5 | 5 | 5 |
| Tetrasodium ethylenediamine tetraacetate | | 5 | 5 | 5 | 5 | 5 | 8 | 8 | 8 |
| Sodium metasilicate | | — | — | — | — | — | — | — | — |
| Sodium molybdate | | — | — | — | — | — | — | — | — |
| pH of surface treatment solution (20° C.) | | 10.0 | 10.0 | 10.0 | 10.0 | 10.0 | 10.5 | 10.5 | 105 |
| Properties | | | | | | | | | |
| Salt spray test (test base-material) | AC41A | Δ | Δ | Δ | Δ | Δ | Δ | Δ | Δ |
| | AG40A | Δ | Δ | Δ | Δ | Δ | Δ | Δ | Δ |
| High-temperature and high-humidity test (test base-material) | AC41A | ○ | ○ | ○ | ○ | ○ | ○ | ○ | ○ |
| | AG40A | ○ | ○ | ○ | ○ | ○ | ○ | ○ | ○ |

TABLE 50

| | | Examples 141-147 | | | | | | |
|---|---|---|---|---|---|---|---|---|
| | | 141 | 142 | 143 | 144 | 145 | 146 | 147 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 87 | 87 | 75 | 75 | 75 | 75 | 75 |
| Manganese dihydrogen phosphate | | 5 | 5 | 10 | 10 | 10 | 10 | 10 |
| Tetrasodium ethylenediamine tetraacetate | | 8 | 8 | 15 | 15 | 15 | 15 | 15 |
| Sodium metasilicate | | — | — | — | — | — | — | — |
| Sodium molybdate | | — | — | — | — | — | — | — |
| pH of surface treatment solution (20° C.) | | 10.5 | 10.5 | 9.5 | 9.5 | 9.5 | 9.5 | 9.5 |
| Properties | | | | | | | | |
| Salt spray test (test base-material) | AC41A | Δ | Δ | Δ | Δ | Δ | Δ | Δ |
| | AG40A | Δ | Δ | Δ | Δ | Δ | Δ | Δ |
| High-temperature and high-humidity test (test base-material) | AC41A | ○ | ○ | ○ | ○ | ○ | ○ | ○ |
| | AG40A | ○ | ○ | ○ | ○ | ○ | ○ | ○ |

TABLE 51

| | Examples 148-155 | | | | | | | |
|---|---|---|---|---|---|---|---|---|
| | 148 | 149 | 150 | 151 | 152 | 153 | 154 | 155 |
| Condition of heating and pressing | | | | | | | | |
| temperature/pressure/time (° C./kgf/cm$^2$/min) | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | |
| Water | 87 | 87 | 87 | 87 | 87 | 79 | 79 | 79 |
| Manganese dihydrogen phosphate | 3 | 3 | 3 | 3 | 3 | 5 | 5 | 5 |
| Tetrasodium ethylenediamine tetraacetate | 5 | 5 | 5 | 5 | 5 | 8 | 8 | 8 |

TABLE 51-continued

| | | Examples 148-155 | | | | | | | |
|---|---|---|---|---|---|---|---|---|---|
| | | 148 | 149 | 150 | 151 | 152 | 153 | 154 | 155 |
| Sodium metasilicate | | 5 | 5 | 5 | 5 | 5 | 8 | 8 | 8 |
| Sodium molybdate | | — | — | — | — | — | — | — | |
| pH of surface treatment solution (20° C.) | | 11.0 | 11.0 | 11.0 | 11.0 | 11.0 | 11.2 | 11.2 | 11.2 |
| Properties | | | | | | | | | |
| Salt spray test (test base-material) | AC41A | Δ | Δ | Δ | ○ | ○ | Δ | Δ | Δ |
| | AG40A | Δ | Δ | Δ | ○ | ○ | Δ | Δ | Δ |
| High-temperature and high-humidity test (test base-material) | AC41A | ○ | ○ | ○ | ○ | ○ | ○ | ○ | ○ |
| | AG40A | ○ | ○ | ○ | ○ | ○ | ○ | ○ | ○ |

TABLE 52

| | | Examples 156-162 | | | | | | |
|---|---|---|---|---|---|---|---|---|
| | | 156 | 157 | 158 | 159 | 160 | 161 | 162 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 79 | 79 | 60 | 60 | 60 | 60 | 60 |
| Manganese dihydrogen phosphate | | 5 | 5 | 10 | 10 | 10 | 10 | 10 |
| Tetrasodium ethylenediamine tetraacetate | | 8 | 8 | 15 | 15 | 15 | 15 | 15 |
| Sodium metasilicate | | 8 | 8 | 15 | 15 | 15 | 15 | 15 |
| Sodium molybdate | | — | — | — | — | — | — | — |
| pH of surface treatment solution (20° C.) | | 11.2 | 11.2 | 11.5 | 11.5 | 11.5 | 11.5 | 11.5 |
| Properties | | | | | | | | |
| Salt spray test (test base-material) | AC41A | ○ | ○ | Δ | Δ | Δ | ○ | ○ |
| | AG40A | ○ | ○ | Δ | Δ | Δ | ○ | ○ |
| High-temperature and high-humidity test (test base-material) | AC41A | ○ | ○ | ○ | ○ | ○ | ○ | ○ |
| | AG40A | ○ | ○ | ○ | ○ | ○ | ○ | ○ |

TABLE 53

| | | Examples 163-170 | | | | | | | |
|---|---|---|---|---|---|---|---|---|---|
| | | 163 | 164 | 165 | 166 | 167 | 168 | 169 | 170 |
| Condition of heating and pressing | | | | | | | | | |
| temperature/pressure/time (° C./kgf/cm$^2$/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 89 | 89 | 89 | 89 | 89 | 82 | 82 | 82 |
| Manganese dihydrogen phosphate | | 3 | 3 | 3 | 3 | 3 | 5 | 5 | 5 |
| Tetrasodium ethylenediamine tetraacetate | | 5 | 5 | 5 | 5 | 5 | 8 | 8 | 8 |
| Sodium metasilicate | | — | — | — | — | — | — | — | — |
| Sodium molybdate | | 3 | 3 | 3 | 3 | 3 | 5 | 5 | 5 |
| pH of surface treatment solution (20° C.) | | 10.0 | 10.0 | 10.0 | 10.0 | 10.0 | 10.5 | 10.5 | 10.5 |
| Properties | | | | | | | | | |
| Salt spray test (test base-material) | AC41A | Δ | Δ | Δ | ○ | ○ | Δ | Δ | Δ |
| | AG40A | Δ | Δ | Δ | ○ | ○ | Δ | Δ | Δ |
| High-temperature and high-humidity test (test base-material) | AC41A | ○ | ○ | ○ | ○ | ○ | ○ | ○ | ○ |
| | AG40A | ○ | ○ | ○ | ○ | ○ | ○ | ○ | ○ |

TABLE 54

| | | Examples 171-177 | | | | | | |
|---|---|---|---|---|---|---|---|---|
| | | 171 | 172 | 173 | 174 | 175 | 176 | 177 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 82 | 82 | 65 | 65 | 65 | 65 | 65 |
| Manganese dihydrogen phosphate | | 5 | 5 | 10 | 10 | 10 | 10 | 10 |
| Tetrasodium ethylenediamine tetraacetate | | 8 | 8 | 15 | 15 | 15 | 15 | 15 |
| Sodium metasilicate | | — | — | — | — | — | — | — |
| Sodium molybdate | | 5 | 5 | 10 | 10 | 10 | 10 | 10 |
| pH of surface treatment solution (20° C.) | | 10.5 | 10.5 | 9.5 | 9.5 | 9.5 | 9.5 | 9.5 |
| Properties | | | | | | | | |
| Salt spray test (test base-material) | AC41A | ○ | ○ | Δ | Δ | Δ | ○ | ○ |
| | AG40A | ○ | ○ | Δ | Δ | Δ | ○ | ○ |
| High-temperature and high-humidity test (test base-material) | AC41A | ○ | ○ | ○ | ○ | ○ | ○ | ○ |
| | AG40A | ○ | ○ | ○ | ○ | ○ | ○ | ○ |

TABLE 55

| | | Examples 178-185 | | | | | | | |
|---|---|---|---|---|---|---|---|---|---|
| | | 178 | 179 | 180 | 181 | 182 | 183 | 184 | 185 |
| Condition of heating and pressing | | | | | | | | | |
| temperature/pressure/time (° C./kgf/cm$^2$/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 87 | 87 | 87 | 87 | 87 | 79 | 79 | 79 |
| Manganese dihydrogen phosphate | | 3 | 3 | 3 | 3 | 3 | 5 | 5 | 5 |
| Tetrasodium ethylenediamine tetraacetate | | 5 | 5 | 5 | 5 | 5 | 8 | 8 | 8 |
| Sodium metasilicate | | 5 | 5 | 5 | 5 | 5 | 8 | 8 | 8 |
| Sodium molybdate | | 3 | 3 | 3 | 3 | 3 | 5 | 5 | 5 |
| pH of surface treatment solution (20° C.) | | 11.0 | 11.0 | 11.0 | 11.0 | 11.0 | 11.2 | 11.2 | 11.2 |
| Properties | | | | | | | | | |
| Salt spray test (test base-material) | AC41A | Δ | Δ | Δ | ○ | ○ | Δ | Δ | Δ |
| | AG40A | Δ | Δ | Δ | ○ | ○ | Δ | Δ | Δ |
| High-temperature and high-humidity test (test base-material) | AC41A | ○ | ○ | ○ | ○ | ○ | ○ | ○ | ○ |
| | AG40A | ○ | ○ | ○ | ○ | ○ | ○ | ○ | ○ |

TABLE 56

| | Examples 186-192 | | | | | | |
|---|---|---|---|---|---|---|---|
| | 186 | 187 | 188 | 189 | 190 | 191 | 192 |
| Condition of heating and pressing | | | | | | | |
| temperature/pressure/time (° C./kgf/cm$^2$/min) | 150/4.5/30 | 200/12/5 | 40/0/120 | 90/0/60 | 40/0.5/60 | 150/4.5/30 | 200/12/5 |
| Concentration of surface treatment agent (%) | | | | | | | |
| Water | 79 | 79 | 60 | 60 | 60 | 60 | 60 |
| Manganese dihydrogen phosphate | 5 | 5 | 10 | 10 | 10 | 10 | 10 |
| Tetrasodium ethylenediamine tetraacetate | 8 | 8 | 15 | 15 | 15 | 15 | 15 |

TABLE 56-continued

| | | Examples 186-192 | | | | | | |
|---|---|---|---|---|---|---|---|---|
| | | 186 | 187 | 188 | 189 | 190 | 191 | 192 |
| Sodium metasilicate | | 8 | 8 | 10 | 10 | 10 | 10 | 10 |
| Sodium molybdate | | 5 | 5 | 10 | 10 | 10 | 10 | 10 |
| pH of surface treatment solution (20° C.) | | 11.2 | 11.2 | 11.5 | 11.5 | 11.5 | 11.5 | 11.5 |
| Properties | | | | | | | | |
| Salt spray test | AC41A | ○ | ○ | Δ | Δ | Δ | ○ | ○ |
| (test base-material) | AG40A | ○ | ○ | Δ | Δ | Δ | ○ | ○ |
| High-temperature and | AC41A | ○ | ○ | ○ | ○ | ○ | ○ | ○ |
| high-humidity test (test base-material) | AG40A | ○ | ○ | ○ | ○ | ○ | ○ | ○ |

COMPARATIVE EXAMPLES 183-250

The treatment agents used as the surface treatment liquids are identical in type to those of Examples 141-192. The surface treatment methods which are not considered to be adequate in terms of condition of heating under pressure or concentration or pH of the treatment agents are cited as Comparative Examples. The conditions of heating under pressure, concentration of the treatment agents and pH of the treatment liquids, and their properties (evaluation results) are shown in TABLES 57 to 65.

TABLE 57

| | | Comparative Examples 183-190 | | | | | | | |
|---|---|---|---|---|---|---|---|---|---|
| | | 183 | 184 | 185 | 186 | 187 | 188 | 189 | 190 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |
| Concentration of surface treatment agent (%) | | | | | | | | | |
| Water | | 92 | 92 | 92 | 92 | 87 | 87 | 87 | 87 |
| Manganese dihydrogen phosphate | | 3 | 3 | 3 | 3 | 5 | 5 | 5 | 5 |
| Tetrasodium ethylenediamine tetraacetate | | 5 | 5 | 5 | 5 | 8 | 8 | 8 | 8 |
| Sodium metasilicate | | — | — | — | — | — | — | — | — |
| Sodium molybdate | | — | — | — | — | — | — | — | |
| pH of surface treatment solution (20° C.) | | 10.0 | 10.0 | 10.0 | 10.0 | 10.5 | 10.5 | 10.5 | 10.5 |
| Properties | | | | | | | | | |
| Salt spray test | AC41A | X | X | X | X | X | X | X | X |
| (test base-material) | AG40A | X | X | X | X | X | X | X | X |
| High-temperature and | AC41A | X | X | X | X | X | X | X | X |
| high-humidity test (test base-material) | AG40A | X | X | X | X | X | X | X | X |

TABLE 58

| | | Comparative Examples 191-198 | | | | | | | |
|---|---|---|---|---|---|---|---|---|---|
| | | 191 | 192 | 193 | 194 | 195 | 196 | 197 | 198 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 75 | 75 | 75 | 75 | 65 | 65 | 65 | 65 |
| Manganese dihydrogen phosphate | | 10 | 10 | 10 | 10 | 15 | 15 | 15 | 15 |
| Tetrasodium ethylenediamine tetraacetate | | 15 | 15 | 15 | 15 | 20 | 20 | 20 | 20 |
| Sodium metasilicate | | — | — | — | — | — | — | — | — |
| Sodium molybdate | | — | — | — | — | — | — | — | |
| pH of surface treatment solution (20° C.) | | 9.5 | 9.5 | 9.5 | 9.5 | 9.5 | 9.5 | 9.5 | 9.5 |

TABLE 58-continued

| | | Comparative Examples 191-198 | | | | | | | |
|---|---|---|---|---|---|---|---|---|---|
| | | 191 | 192 | 193 | 194 | 195 | 196 | 197 | 198 |
| Properties | | | | | | | | | |
| Salt spray test | AC41A | X | X | X | X | Δ | Δ | Δ | ○ |
| (test base-material) | AG40A | X | X | X | X | Δ | Δ | Δ | ○ |
| High-temperature and | AC41A | X | X | X | X | X | X | X | X |
| high-humidity test | AG40A | X | X | X | X | X | X | X | X |
| (test base-material) | | | | | | | | | |

TABLE 59

| | | Comparative Examples 199-206 | | | | | | | |
|---|---|---|---|---|---|---|---|---|---|
| | | 199 | 200 | 201 | 202 | 203 | 204 | 205 | 206 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |
| Concentration of surface treatment agent (%) | | | | | | | | | |
| Water | | 87 | 87 | 87 | 87 | 79 | 79 | 79 | 79 |
| Manganese dihydrogen phosphate | | 3 | 3 | 3 | 3 | 5 | 5 | 5 | 5 |
| Tetrasodium ethylenediamine tetraacetate | | 5 | 5 | 5 | 5 | 8 | 8 | 8 | 8 |
| Sodium metasilicate | | 5 | 5 | 5 | 5 | 8 | 8 | 8 | 8 |
| Sodium molybdate | | — | — | — | — | — | — | — | |
| pH of surface treatment solution (20° C.) | | 11.0 | 11.0 | 11.0 | 11.0 | 11.2 | 11.2 | 11.2 | 11.2 |
| Properties | | | | | | | | | |
| Salt spray test | AC41A | X | X | X | X | X | X | X | X |
| (test base-material) | AG40A | X | X | X | X | X | X | X | X |
| High-temperature and | AC41A | X | X | X | X | X | X | X | X |
| high-humidity test | AG40A | X | X | X | X | X | X | X | X |
| (test base-material) | | | | | | | | | |

TABLE 60

| | | Comparative Examples 207-214 | | | | | | | |
|---|---|---|---|---|---|---|---|---|---|
| | | 207 | 208 | 209 | 210 | 211 | 212 | 213 | 214 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 60 | 60 | 60 | 60 | 45 | 45 | 45 | 45 |
| Manganese dihydrogen phosphate | | 10 | 10 | 10 | 10 | 15 | 15 | 15 | 15 |
| Tetrasodium ethylenediamine tetraacetate | | 15 | 15 | 15 | 15 | 20 | 20 | 20 | 20 |
| Sodium metasilicate | | 15 | 15 | 15 | 15 | 20 | 20 | 20 | 20 |
| Sodium molybdate | | — | — | — | — | — | — | — | |
| pH of surface treatment solution (20° C.) | | 11.5 | 11.5 | 11.5 | 11.5 | 11.7 | 11.7 | 11.7 | 11.7 |
| Properties | | | | | | | | | |
| Salt spray test | AC41A | X | X | X | X | Δ | Δ | Δ | ○ |
| (test base-material) | AG40A | X | X | X | X | Δ | Δ | Δ | ○ |
| High-temperature and | AC41A | X | X | X | X | X | X | X | X |
| high-humidity test | AG40A | X | X | X | X | X | X | X | X |
| (test base-material) | | | | | | | | | |

TABLE 61

| | | Comparative Examples 215-222 | | | | | | | |
|---|---|---|---|---|---|---|---|---|---|
| | | 215 | 216 | 217 | 218 | 219 | 220 | 221 | 222 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |
| Concentration of surface treatment agent (%) | | | | | | | | | |
| Water | | 92 | 92 | 92 | 92 | 87 | 87 | 87 | 87 |
| Manganese dihydrogen phosphate | | 3 | 3 | 3 | 3 | 5 | 5 | 5 | 5 |
| Tetrasodium ethylenediamine tetraacetate | | 5 | 5 | 5 | 5 | 8 | 8 | 8 | 8 |
| Sodium metasilicate | | — | — | — | — | — | — | — | — |
| Sodium molybdate | | 3 | 3 | 3 | 3 | 5 | 5 | 5 | 5 |
| pH of surface treatment solution (20° C.) | | 10.0 | 10.0 | 10.0 | 10.0 | 10.5 | 10.5 | 10.5 | 10.5 |
| Properties | | | | | | | | | |
| Salt spray test (test base-material) | AC41A | X | X | X | X | X | X | X | X |
| | AG40A | X | X | X | X | X | X | X | X |
| High-temperature and high-humidity test (test base-material) | AC41A | X | X | X | X | X | X | X | X |
| | AG40A | X | X | X | X | X | X | X | X |

TABLE 62

| | | Comparative Examples 223-230 | | | | | | | |
|---|---|---|---|---|---|---|---|---|---|
| | | 223 | 224 | 225 | 226 | 227 | 228 | 229 | 230 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 75 | 75 | 75 | 75 | 65 | 65 | 65 | 65 |
| Manganese dihydrogen phosphate | | 10 | 10 | 10 | 10 | 15 | 15 | 15 | 15 |
| Tetrasodium ethylenediamine tetraacetate | | 15 | 15 | 15 | 15 | 20 | 20 | 20 | 20 |
| Sodium metasilicate | | — | — | — | — | — | — | — | — |
| Sodium molybdate | | 10 | 10 | 10 | 10 | 15 | 15 | 15 | 15 |
| pH of surface treatment solution (20° C.) | | 9.5 | 9.5 | 9.5 | 9.5 | 9.5 | 9.5 | 9.5 | 9.5 |
| Properties | | | | | | | | | |
| Salt spray test (test base-material) | AC41A | X | X | X | X | Δ | Δ | Δ | ○ |
| | AG40A | X | X | X | X | Δ | Δ | Δ | ○ |
| High-temperature and high-humidity test (test base-material) | AC41A | X | X | X | X | X | X | X | X |
| | AG40A | X | X | X | X | X | X | X | X |

TABLE 63

| | Comparative Examples 231-238 | | | | | | | |
|---|---|---|---|---|---|---|---|---|
| | 231 | 232 | 233 | 234 | 235 | 236 | 237 | 238 |
| Condition of heating and pressing | | | | | | | | |
| temperature/pressure/time (° C./kgf/cm$^2$/min) | 30/0/60 | 30/0.2/30 | 30/0.2/60 | 200/12/0.5 | 30/0/60 | 30/0.2/30 | 30/0.2/60 | 200/12/0.5 |
| Concentration of surface treatment agent (%) | | | | | | | | |
| Water | 87 | 87 | 87 | 87 | 79 | 79 | 79 | 79 |
| Manganese dihydrogen phosphate | 3 | 3 | 3 | 3 | 5 | 5 | 5 | 5 |
| Tetrasodium ethylenediamine tetraacetate | 5 | 5 | 5 | 5 | 8 | 8 | 8 | 8 |

TABLE 63-continued

| | | Comparative Examples 231-238 | | | | | | | |
|---|---|---|---|---|---|---|---|---|---|
| | | 231 | 232 | 233 | 234 | 235 | 236 | 237 | 238 |
| Sodium metasilicate | | 5 | 5 | 5 | 5 | 8 | 8 | 8 | 8 |
| Sodium molybdate | | 3 | 3 | 3 | 3 | 5 | 5 | 5 | 5 |
| pH of surface treatment solution (20° C.) | | 11.0 | 11.0 | 11.0 | 11.0 | 11.2 | 11.2 | 11.2 | 11.2 |
| Properties | | | | | | | | | |
| Salt spray test | AC41A | X | X | X | X | X | X | X | X |
| (test base-material) | AG40A | X | X | X | X | X | X | X | X |
| High-temperature and | AC41A | X | X | X | X | X | X | X | X |
| high-humidity test | AG40A | X | X | X | X | X | X | X | X |
| (test base-material) | | | | | | | | | |

TABLE 64

| | | Comparative Examples 239-242 | | | |
|---|---|---|---|---|---|
| | | 239 | 240 | 241 | 242 |
| Condition of heating and pressing | | | | | |
| temperature/pressure/time (° C./kgf/cm$^2$/min) | | 30/0/60 | 30/0.2/30 | 30/0.2/60 | 200/12/0.5 |
| Concentration of surface treatment agent (%) | | | | | |
| Water | | 60 | 60 | 60 | 60 |
| Manganese dihydrogen phosphate | | 10 | 10 | 10 | 10 |
| Tetrasodium ethylenediamine tetraacetate | | 15 | 15 | 15 | 15 |
| Sodium metasilicate | | 15 | 15 | 15 | 15 |
| Sodium molybdate | | 10 | 10 | 10 | 10 |
| pH of surface treatment solution (20° C.) | | 11.5 | 11.5 | 11.5 | 11.5 |
| Properties | | | | | |
| Salt spray test | AC41A | X | X | X | X |
| (test base-material) | AG40A | X | X | X | X |
| High-temperature and | AC41A | X | X | X | X |
| high-humidity test | AG40A | X | X | X | X |
| (test base-material) | | | | | |

TABLE 65

| | | Comparative Examples 243-250 | | | | | | | |
|---|---|---|---|---|---|---|---|---|---|
| | | 243 | 244 | 245 | 246 | 247 | 248 | 249 | 250 |
| Condition of heating and pressing | | | | | | | | | |
| temperature/pressure/time (° C./kgf/cm$^2$/min) | | 150/4.5/30 | 150/4.5/30 | 150/4.5/30 | 150/4.5/30 | 150/4.5/30 | 150/4.5/30 | 150/4.5/30 | 150/4.5/30 |
| Concentration of surface treatment agent (%) | | | | | | | | | |
| Water | | 92 | 87 | 75 | 90 | 83 | 67 | 91 | 89 |
| Manganese dihydrogen phosphate | | 3 | 5 | 10 | 3 | 5 | 10 | 3 | 3 |
| Tetrasodium ethylenediamine tetraacetate | | 5 | 8 | 15 | 5 | 8 | 15 | 3 | 3 |
| Sodium metasilicate | | — | — | — | 2 | 4 | 8 | | 2 |
| Sodium molybdate | | — | — | — | — | — | — | 3 | 3 |

TABLE 65-continued

| | Comparative Examples 243-250 | | | | | | | |
|---|---|---|---|---|---|---|---|---|
| | 243 | 244 | 245 | 246 | 247 | 248 | 249 | 250 |
| pH of surface treatment solution (20° C.) | 5.0 | 5.0 | 5.0 | 8.0 | 8.0 | 8.0 | 6.0 | 7.0 |
| Change in dimension and surface profile of test piece (test base-material) | | | | | | | | |
| AC41A | Nonuniform surface is found (rough surface) | | | | | | | |
| AG40A | Nonuniform surface is found (rough surface) | | | | | | | |

From comparison between Examples 133-192 of TABLES 49-56 and Comparative Examples 183-250 of TABLES 57-65 it was found that in Examples 133-192, the rust resisting time in the salt spray test was 24 hours or more or 100 hours or more and the rust resisting time in the high-temperature-and-high-moisture test was 200 hours or more. In contrast to this, Comparative Examples 183-241 were all rejected in terms of the rust resisting time in the high-temperature-and-high-moisture test. Also, Comparative Examples 243-250 were less than 9 in pH of the surface treatment liquid, such that the non-uniform surface resulting from corrosion was found.

Following facts were found from the salt spray test results of Comparative Examples.

Comparative Examples 183-185, 187-189, 191-193, 200-201, 203-205, 207-209, 215-217, 219-221, 223-225, 231-233, 235-237 and 239-241 were rejected. This is because the surface treatment conditions were not fulfilled in that the heating temperature was as low as 30° C. (less than 35° C.), the pressure was zero or 0.2 kgf/cm$^2$, etc. Comparative Examples 186, 190, 194, 202, 206, 210, 218, 222, 226, 234, 238 and 242 were rejected. This is because although the heating temperature was as high as 200° C. and also the pressure was as high as 12 kgf/cm$^2$, the processing time was as significantly short as 0.5 min. (less than one minute). Comparative Examples 195-198, 211-214 and 227-230 were evaluated to be acceptable in the salt spray test, despite of being rejected in terms of the rust resisting time in the high-temperature-and-high-moisture test. This is probably because the surface treatment conditions were adequate.

On the other hand, comparative Examples 211-214 and 227-230 were rejected in terms of the rust resisting time in the high-temperature-and-high-moisture test, despite of being adequate in the surface treatment conditions. This was due to the concentration of components of the surface treatment liquid. In Comparative Examples 195-198, the manganese dihydrogen phosphate concentration was in excess of 10% and the ethylenediamine tetrasodium tetraacetate concentration was in excess of 15%. In Comparative Examples 211-214, the sodium metasilicate concentration was in excess of 15%, in addition to those concentrations. This probably caused the residual of the surface treatment liquid to adhere to the surface of the test pieces, resulting in the rejection. Comparative Examples 227-230, the manganese dihydrogen phosphate concentration was in excess of 10% and the ethylenediamine tetrasodium tetraacetate concentration was in excess of 15% and also 15% of sodium molybdate was added. This probably caused the residual of the surface treatment liquid to adhere to the surface of the test pieces, resulting in the rejection.

Examples using the aqueous solution to which no silicate or molybdenum compound was added (Examples 133-147) were all evaluated to fall under the category "Δ" in the salt spray test (the rust resisting time in the range of 24 hours or more to less than 100 hours). On the other hand, some of Examples using the aqueous solution to which silicate or molybdenum compound was added (Examples 148-192) were evaluated to fall under the category "○" in the salt spray test (the rust resisting time of 100 hours or more) under the conditions of heating under pressure: 150° C./4.5 kgf/cm$^2$/30 minutes or 200° C./12 kgf/cm$^2$/5 minutes. It can be said from this fact that the addition of silicate or molybdenum compound produced an improved rust resistance as a whole.

(4) Fourth, Reference will Made to the Iron Alloy.

(Test Piece)

The evaluation test base-materials of the iron alloys used were JIS standard products: FC200 (C: 3.37%; Si: 1.53%, Mn: 0.55% and Residual Fe-size 3×25×50 mm); S45C (C: 0.42-0.48%; Si: 0.15-0.35%, Mn: 0.6-0.9% and Residual Fe-size 3×25×50 mm); and SPCC (C: not more than 0.12%; Mn: not more than 0.5%; P: not more than 0.04% and Residual Fe-size 3×25×50 mm), all of which were not subjected to the pre-cleaning process using acid, alkali, or organic solvent. It is to be noted that FC200 is cast metal material and S45C and SPCC are expanded metal materials.

The surface treatment of the iron alloys was made in the same manner as in that of the magnesium alloys.

(Testing and Evaluation Method)

The corrosion resistance of the surface treatment coating thus formed was visually observed on whether the red rust occurs on the surface of the test base-material in accordance with JIS Z 2371 (salt spray test method) and the time required for the white rust to occur (hereinafter it is referred to as "rust resisting time" was measured in the same manner as in that of the magnesium alloys. Then, the evaluation was classified into three stages with reference to the judgment standard shown in TABLE 66. The rust resisting time of less than 5 hours that falls under the category "x" means that it is likely that some problem may be caused at least in practice. The rust resisting time of 5 hours or more that falls under the category "Δ" or "○" means that it is likely that no problem may be caused at least in practice. When it takes longer before the red rust occurs, the surface treatment coating is considered to be excellent in rust resistance.

TABLE 66

| | |
|---|---|
| X | Less than 5 hours |
| Δ | 5 hours or more to less than 24 hours |
| ○ | 24 hours or more |

In evaluating the adhesion of the surface treatment coating to the corrosion-resistant paint, the same paints as those in the magnesium alloys were used and applied to the test base-materials in the same manner as in the magnesium alloys, to form a paint film having thickness of 20-40 μm thereon. The tests were made according to the provision of "Cross-cut adhesion test" at Article 8.5.1 of JIS K 5400 (Paint—General test method). In detail, after a check pattern (1 mm×1 mm: 100 grids) was drawn on the test pieces, an adhesive cellophane tape prescribed by JIS Z 1522 was stuck thereon and the number of residual grids after taped up was measured.

The evaluation was classified with reference to the judgment standard shown in TABLE 67 (which corresponds to TABLE 2) in the same manner as in the magnesium alloys.

The number of residual grids of less than 100 that falls under the category "x" means that it is likely that some problem may be caused at least in practice. The number of residual grids of 100 that falls under the category "○" means that it is likely that no problem may be caused at least in practice.

TABLE 67

| | |
|---|---|
| X | Residual grid number of less than 100 |
| ○ | Residual grid number of 100 |

EXAMPLES 193-252

In these examples, the same surface treatment liquids as those in the Examples using the magnesium alloys were used for the surface treatment of the iron alloy. The conditions of heating under pressure, concentration of the treatment agents, pH of the treatment liquids, and their properties (evaluation results) are shown in TABLES 68 to 75. It is to be noted that when all the paints mentioned above were evaluated on adhesion of the paint, no substantial difference was found in the evaluation results. The same thing applies to the comparative examples mentioned later.

TABLE 68

| | | Examples 193-200 | | | | | | | |
|---|---|---|---|---|---|---|---|---|---|
| | | 193 | 194 | 195 | 196 | 197 | 198 | 199 | 200 |
| Condition of heating and pressing | | | | | | | | | |
| temperature/pressure/time (° C./kgf/cm$^2$/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 92 | 92 | 92 | 92 | 92 | 87 | 87 | 87 |
| Manganese dihydrogen phosphate | | 3 | 3 | 3 | 3 | 3 | 5 | 5 | 5 |
| Tetrasodium ethylenediamine tetraacetate | | 5 | 5 | 5 | 5 | 5 | 8 | 8 | 8 |
| Sodium metasilicate | | — | — | — | — | — | — | — | — |
| Sodium molybdate | | — | — | — | — | — | — | — | — |
| pH of surface treatment solution (20° C.) | | 10.0 | 10.0 | 10.0 | 10.0 | 10.0 | 10.5 | 10.5 | 10.5 |
| Properties | | | | | | | | | |
| Salt spray test (test base-material) | FC200 | Δ | Δ | Δ | Δ | Δ | Δ | Δ | Δ |
| | S45C | Δ | Δ | Δ | Δ | Δ | Δ | Δ | Δ |
| | SPCC | Δ | Δ | Δ | Δ | Δ | Δ | Δ | Δ |
| Adhesion of coating paint (test base-material) | FC200 | ○ | ○ | ○ | ○ | ○ | ○ | ○ | ○ |
| | S45C | ○ | ○ | ○ | ○ | ○ | ○ | ○ | ○ |
| | SPCC | ○ | ○ | ○ | ○ | ○ | ○ | ○ | ○ |

TABLE 69

| | Examples 201-207 | | | | | | |
|---|---|---|---|---|---|---|---|
| | 201 | 202 | 203 | 204 | 205 | 206 | 207 |
| Condition of heating and pressing | | | | | | | |
| temperature/pressure/time (° C./kgf/cm$^2$/min) | 150/4.5/30 | 200/12/5 | 40/0/120 | 90/0/60 | 40/0.5/60 | 150/4.5/30 | 200/12/5 |
| Concentration of surface treatment agent (%) | | | | | | | |
| Water | 87 | 87 | 75 | 75 | 75 | 75 | 75 |
| Manganese dihydrogen phosphate | 5 | 5 | 10 | 10 | 10 | 10 | 10 |
| Tetrasodium ethylenediamine tetraacetate | 8 | 8 | 15 | 15 | 15 | 15 | 15 |
| Sodium metasilicate | — | — | — | — | — | — | — |
| Sodium molybdate | — | — | — | — | — | — | — |
| pH of surface treatment solution (20° C.) | 10.5 | 10.5 | 9.5 | 9.5 | 9.5 | 9.5 | 9.5 |

TABLE 69-continued

| | | Examples 201-207 | | | | | | |
|---|---|---|---|---|---|---|---|---|
| | | 201 | 202 | 203 | 204 | 205 | 206 | 207 |
| Properties | | | | | | | | |
| Salt spray test | FC200 | Δ | Δ | Δ | Δ | Δ | Δ | Δ |
| (test base-material) | S45C | Δ | Δ | Δ | Δ | Δ | Δ | Δ |
| | SPCC | Δ | Δ | Δ | Δ | Δ | Δ | Δ |
| Adhesion of coating | FC200 | ○ | ○ | ○ | ○ | ○ | ○ | ○ |
| paint | S45C | ○ | ○ | ○ | ○ | ○ | ○ | ○ |
| (test base-material) | SPCC | ○ | ○ | ○ | ○ | ○ | ○ | ○ |

TABLE 70

| | | Examples 208-215 | | | | | | | |
|---|---|---|---|---|---|---|---|---|---|
| | | 208 | 209 | 210 | 211 | 212 | 213 | 214 | 215 |
| Condition of heating and pressing | | | | | | | | | |
| temperature/pressure/time (° C./kgf/cm$^2$/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 87 | 87 | 87 | 87 | 87 | 79 | 79 | 79 |
| Manganese dihydrogen phosphate | | 3 | 3 | 3 | 3 | 3 | 5 | 5 | 5 |
| Tetrasodium ethylenediamine tetraacetate | | 5 | 5 | 5 | 5 | 5 | 8 | 8 | 8 |
| Sodium metasilicate | | 5 | 5 | 5 | 5 | 5 | 8 | 8 | 8 |
| Sodium molybdate | | — | — | — | — | — | — | — | — |
| pH of surface treatment solution (20° C.) | | 11.0 | 11.0 | 11.0 | 11.0 | 11.0 | 11.2 | 11.2 | 11.2 |
| Properties | | | | | | | | | |
| Salt spray test | FC200 | Δ | Δ | Δ | ○ | ○ | Δ | Δ | Δ |
| (test base-material) | S45C | Δ | Δ | Δ | ○ | ○ | Δ | Δ | Δ |
| | SPCC | Δ | Δ | Δ | ○ | ○ | Δ | Δ | Δ |
| Adhesion of coating | FC200 | ○ | ○ | ○ | ○ | ○ | ○ | ○ | ○ |
| paint | S45C | ○ | ○ | ○ | ○ | ○ | ○ | ○ | ○ |
| (test base-material) | SPCC | ○ | ○ | ○ | ○ | ○ | ○ | ○ | ○ |

TABLE 71

| | | Examples 216-222 | | | | | | |
|---|---|---|---|---|---|---|---|---|
| | | 216 | 217 | 218 | 219 | 220 | 221 | 222 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 79 | 79 | 60 | 60 | 60 | 60 | 60 |
| Manganese dihydrogen phosphate | | 5 | 5 | 10 | 10 | 10 | 10 | 10 |
| Tetrasodium ethylenediamine tetraacetate | | 8 | 8 | 15 | 15 | 15 | 15 | 15 |
| Sodium metasilicate | | 8 | 8 | 15 | 15 | 15 | 15 | 15 |
| Sodium molybdate | | — | — | — | — | — | — | — |
| pH of surface treatment solution (20° C.) | | 11.2 | 11.2 | 11.5 | 11.5 | 11.5 | 11.5 | 11.5 |
| Properties | | | | | | | | |
| Salt spray test | FC200 | ○ | ○ | Δ | Δ | Δ | ○ | ○ |
| (test base-material) | S45C | ○ | ○ | Δ | Δ | Δ | ○ | ○ |
| | SPCC | ○ | ○ | Δ | Δ | Δ | ○ | ○ |

TABLE 71-continued

| | | Examples 216-222 | | | | | | |
|---|---|---|---|---|---|---|---|---|
| | | 216 | 217 | 218 | 219 | 220 | 221 | 222 |
| Adhesion of coating | FC200 | ○ | ○ | ○ | ○ | ○ | ○ | ○ |
| paint | S45C | ○ | ○ | ○ | ○ | ○ | ○ | ○ |
| (test base-material) | SPCC | ○ | ○ | ○ | ○ | ○ | ○ | ○ |

TABLE 72

| | | Examples 223-230 | | | | | | | |
|---|---|---|---|---|---|---|---|---|---|
| | | 223 | 224 | 225 | 226 | 227 | 228 | 229 | 230 |
| Condition of heating and pressing | | | | | | | | | |
| temperature/pressure/time (° C./kgf/cm$^2$/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 89 | 89 | 89 | 89 | 89 | 82 | 82 | 82 |
| Manganese dihydrogen phosphate | | 3 | 3 | 3 | 3 | 3 | 5 | 5 | 5 |
| Tetrasodium ethylenediamine tetraacetate | | 5 | 5 | 5 | 5 | 5 | 8 | 8 | 8 |
| Sodium metasilicate | | — | — | — | — | — | — | — | — |
| Sodium molybdate | | 3 | 3 | 3 | 3 | 3 | 5 | 5 | 5 |
| pH of surface treatment solution (20° C.) | | 10.0 | 10.0 | 10.0 | 10.0 | 10.0 | 10.5 | 10.5 | 10.5 |
| Properties | | | | | | | | | |
| Salt spray test | FC200 | Δ | Δ | Δ | ○ | ○ | Δ | Δ | Δ |
| (test base-material) | S45C | Δ | Δ | Δ | ○ | ○ | Δ | Δ | Δ |
| | SPCC | Δ | Δ | Δ | ○ | ○ | Δ | Δ | Δ |
| Adhesion of coating | FC200 | ○ | ○ | ○ | ○ | ○ | ○ | ○ | ○ |
| paint | S45C | ○ | ○ | ○ | ○ | ○ | ○ | ○ | ○ |
| (test base-material) | SPCC | ○ | ○ | ○ | ○ | ○ | ○ | ○ | ○ |

TABLE 73

| | | Examples 231-237 | | | | | | |
|---|---|---|---|---|---|---|---|---|
| | | 231 | 232 | 233 | 234 | 235 | 236 | 237 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 82 | 82 | 65 | 65 | 65 | 65 | 65 |
| Manganese dihydrogen phosphate | | 5 | 5 | 10 | 10 | 10 | 10 | 10 |
| Tetrasodium ethylenediamine tetraacetate | | 8 | 8 | 15 | 15 | 15 | 15 | 15 |
| Sodium metasilicate | | — | — | — | — | — | — | — |
| Sodium molybdate | | 5 | 5 | 10 | 10 | 10 | 10 | 10 |
| pH of surface treatment solution (20° C.) | | 10.5 | 10.5 | 9.5 | 9.5 | 9.5 | 9.5 | 9.5 |
| Properties | | | | | | | | |
| Salt spray test | FC200 | ○ | ○ | Δ | Δ | Δ | ○ | ○ |
| (test base-material) | S45C | ○ | ○ | Δ | Δ | Δ | ○ | ○ |
| | SPCC | ○ | ○ | Δ | Δ | Δ | ○ | ○ |
| Adhesion of coating | FC200 | ○ | ○ | ○ | ○ | ○ | ○ | ○ |
| paint | S45C | ○ | ○ | ○ | ○ | ○ | ○ | ○ |
| (test base-material) | SPCC | ○ | ○ | ○ | ○ | ○ | ○ | ○ |

TABLE 74

| | | Examples 238-245 | | | | | | | |
|---|---|---|---|---|---|---|---|---|---|
| | | 238 | 239 | 240 | 241 | 242 | 243 | 244 | 245 |
| Condition of heating and pressing | | | | | | | | | |
| temperature/pressure/time (° C./kgf/cm$^2$/min) | | 40/0/120 | 90/0/60 | 40/0.5/60 | 150/4.5/30 | 200/12/5 | 40/0/120 | 90/0/60 | 40/0.5/60 |
| Concentration of surface treatment agent (%) | | | | | | | | | |
| Water | | 87 | 87 | 87 | 87 | 87 | 79 | 79 | 79 |
| Manganese dihydrogen phosphate | | 3 | 3 | 3 | 3 | 3 | 5 | 5 | 5 |
| Tetrasodium ethylenediamine tetraacetate | | 5 | 5 | 5 | 5 | 5 | 8 | 8 | 8 |
| Sodium metasilicate | | 5 | 5 | 5 | 5 | 5 | 8 | 8 | 8 |
| Sodium molybdate | | 3 | 3 | 3 | 3 | 3 | 5 | 5 | 5 |
| pH of surface treatment solution (20° C.) | | 11.0 | 11.0 | 11.0 | 11.0 | 11.0 | 11.2 | 11.2 | 11.2 |
| Properties | | | | | | | | | |
| Salt spray test (test base-material) | FC200 | Δ | Δ | Δ | ○ | ○ | Δ | Δ | Δ |
| | S45C | Δ | Δ | Δ | ○ | ○ | Δ | Δ | Δ |
| | SPCC | Δ | Δ | Δ | ○ | ○ | Δ | Δ | Δ |
| Adhesion of coating paint (test base-material) | FC200 | ○ | ○ | ○ | ○ | ○ | ○ | ○ | ○ |
| | S45C | ○ | ○ | ○ | ○ | ○ | ○ | ○ | ○ |
| | SPCC | ○ | ○ | ○ | ○ | ○ | ○ | ○ | ○ |

TABLE 75

| | | Examples 246-252 | | | | | | |
|---|---|---|---|---|---|---|---|---|
| | | 246 | 247 | 248 | 249 | 250 | 251 | 252 |
| Condition of heating and pressing | | | | | | | | |
| temperature/pressure/time (° C./kgf/cm$^2$/min) | | 150/4.5/30 | 200/12/5 | 40/0/120 | 90/0/60 | 40/0.5/60 | 150/4.5/30 | 200/12/5 |
| Concentration of surface treatment agent (%) | | | | | | | | |
| Water | | 79 | 79 | 60 | 60 | 60 | 60 | 60 |
| Manganese dihydrogen phosphate | | 5 | 5 | 10 | 10 | 10 | 10 | 10 |
| Tetrasodium ethylenediamine tetraacetate | | 8 | 8 | 15 | 15 | 15 | 15 | 15 |
| Sodium metasilicate | | 8 | 8 | 10 | 10 | 10 | 10 | 10 |
| Sodium molybdate | | 5 | 5 | 10 | 10 | 10 | 10 | 10 |
| pH of surface treatment solution (20° C.) | | 11.2 | 11.2 | 11.5 | 11.5 | 11.5 | 11.5 | 11.5 |
| Properties | | | | | | | | |
| Salt spray test (test base-material) | FC200 | ○ | ○ | Δ | Δ | Δ | ○ | ○ |
| | S45C | ○ | ○ | Δ | Δ | Δ | ○ | ○ |
| | SPCC | ○ | ○ | Δ | Δ | Δ | ○ | ○ |
| Adhesion of coating paint (test base-material) | FC200 | ○ | ○ | ○ | ○ | ○ | ○ | ○ |
| | S45C | ○ | ○ | ○ | ○ | ○ | ○ | ○ |
| | SPCC | ○ | ○ | ○ | ○ | ○ | ○ | ○ |

COMPARATIVE EXAMPLES 251-318

The treatment agents used as the surface treatment liquids are identical in type to those of Examples 193-252. The surface treatment methods which are not considered to be adequate in terms of condition of heating under pressure or concentration or pH of the treatment agents are cited as Comparative Examples. The conditions of heating under pressure, concentration of the treatment agents and pH of the treatment liquids, and their properties (evaluation results) are shown in TABLES 76 to 84.

TABLE 76

| | | Comparative Examples 251-258 | | | | | | | |
|---|---|---|---|---|---|---|---|---|---|
| | | 251 | 252 | 253 | 254 | 255 | 256 | 257 | 258 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |
| Concentration of surface treatment agent (%) | | | | | | | | | |
| Water | | 92 | 92 | 92 | 92 | 87 | 87 | 87 | 87 |
| Manganese dihydrogen phosphate | | 3 | 3 | 3 | 3 | 5 | 5 | 5 | 5 |
| Tetrasodium ethylenediamine tetraacetate | | 5 | 5 | 5 | 5 | 8 | 8 | 8 | 8 |
| Sodium metasilicate | | — | — | — | — | — | — | — | — |
| Sodium molybdate | | — | — | — | — | — | — | — | — |
| pH of surface treatment solution (20° C.) | | 10.0 | 10.0 | 10.0 | 10.0 | 10.5 | 10.5 | 10.5 | 10.5 |
| Properties | | | | | | | | | |
| Salt spray test | FC200 | X | X | X | X | X | X | X | X |
| (test base-material) | S45C | X | X | X | X | X | X | X | X |
| | SPCC | X | X | X | X | X | X | X | X |
| Adhesion of coating | FC200 | X | X | X | X | X | X | X | X |
| paint | S45C | X | X | X | X | X | X | X | X |
| (test base-material) | SPCC | X | X | X | X | X | X | X | X |

TABLE 77

| | | Comparative Examples 259-266 | | | | | | | |
|---|---|---|---|---|---|---|---|---|---|
| | | 259 | 260 | 261 | 262 | 263 | 264 | 265 | 266 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 75 | 75 | 75 | 75 | 65 | 65 | 65 | 65 |
| Manganese dihydrogen phosphate | | 10 | 10 | 10 | 10 | 15 | 15 | 15 | 15 |
| Tetrasodium ethylenediamine tetraacetate | | 15 | 15 | 15 | 15 | 20 | 20 | 20 | 20 |
| Sodium metasilicate | | — | — | — | — | — | — | — | — |
| Sodium molybdate | | — | — | — | — | — | — | — | — |
| pH of surface treatment solution (20° C.) | | 9.5 | 9.5 | 9.5 | 9.5 | 9.5 | 9.5 | 9.5 | 9.5 |
| Properties | | | | | | | | | |
| Salt spray test | FC200 | X | X | X | X | Δ | Δ | Δ | ○ |
| (test base-material) | S45C | X | X | X | X | Δ | Δ | Δ | ○ |
| | SPCC | X | X | X | X | Δ | Δ | Δ | ○ |
| Adhesion of coating | FC200 | X | X | X | X | X | X | X | X |
| paint | S45C | X | X | X | X | X | X | X | X |
| (test base-material) | SPCC | X | X | X | X | X | X | X | X |

TABLE 78

| | | Comparative Examples 267-274 | | | | | | | |
|---|---|---|---|---|---|---|---|---|---|
| | | 267 | 268 | 269 | 270 | 271 | 272 | 273 | 274 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |

TABLE 78-continued

| | | Comparative Examples 267-274 | | | | | | | |
|---|---|---|---|---|---|---|---|---|---|
| | | 267 | 268 | 269 | 270 | 271 | 272 | 273 | 274 |
| Concentration of surface treatment agent (%) | | | | | | | | | |
| Water | | 87 | 87 | 87 | 87 | 79 | 79 | 79 | 79 |
| Manganese dihydrogen phosphate | | 3 | 3 | 3 | 3 | 5 | 5 | 5 | 5 |
| Tetrasodium ethylenediamine tetraacetate | | 5 | 5 | 5 | 5 | 8 | 8 | 8 | 8 |
| Sodium metasilicate | | 5 | 5 | 5 | 5 | 8 | 8 | 8 | 8 |
| Sodium molybdate | | — | — | — | — | — | — | — | — |
| pH of surface treatment solution (20° C.) | | 11.0 | 11.0 | 11.0 | 11.0 | 11.2 | 11.2 | 11.2 | 11.2 |
| Properties | | | | | | | | | |
| Salt spray test | FC200 | X | X | X | X | X | X | X | X |
| (test base-material) | S45C | X | X | X | X | X | X | X | X |
| | SPCC | X | X | X | X | X | X | X | X |
| Adhesion of coating | FC200 | X | X | X | X | X | X | X | X |
| paint | S45C | X | X | X | X | X | X | X | X |
| (test base-material) | SPCC | X | X | X | X | X | X | X | X |

TABLE 79

| | | Comparative Examples 275-282 | | | | | | | |
|---|---|---|---|---|---|---|---|---|---|
| | | 275 | 276 | 277 | 278 | 279 | 280 | 281 | 282 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 60 | 60 | 60 | 60 | 45 | 45 | 45 | 45 |
| Manganese dihydrogen phosphate | | 10 | 10 | 10 | 10 | 15 | 15 | 15 | 15 |
| Tetrasodium ethylenediamine tetraacetate | | 15 | 15 | 15 | 15 | 20 | 20 | 20 | 20 |
| Sodium metasilicate | | 15 | 15 | 15 | 15 | 20 | 20 | 20 | 20 |
| Sodium molybdate | | — | — | — | — | — | — | — | — |
| pH of surface treatment solution (20° C.) | | 11.5 | 11.5 | 11.5 | 11.5 | 11.7 | 11.7 | 11.7 | 11.7 |
| Properties | | | | | | | | | |
| Salt spray test | FC200 | X | X | X | X | Δ | Δ | Δ | ○ |
| (test base-material) | S45C | X | X | X | X | Δ | Δ | Δ | ○ |
| | SPCC | X | X | X | X | Δ | Δ | Δ | ○ |
| Adhesion of coating | FC200 | X | X | X | X | X | X | X | X |
| paint | S45C | X | X | X | X | X | X | X | X |
| (test base-material) | SPCC | X | X | X | X | X | X | X | X |

TABLE 80

| | | Comparative Examples 283-290 | | | | | | | |
|---|---|---|---|---|---|---|---|---|---|
| | | 283 | 284 | 285 | 286 | 287 | 288 | 289 | 290 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |
| Concentration of surface treatment agent (%) | | | | | | | | | |
| Water | | 92 | 92 | 92 | 92 | 87 | 87 | 87 | 87 |
| Manganese dihydrogen phosphate | | 3 | 3 | 3 | 3 | 5 | 5 | 5 | 5 |
| Tetrasodium ethylenediamine tetraacetate | | 5 | 5 | 5 | 5 | 8 | 8 | 8 | 8 |

TABLE 80-continued

| | | Comparative Examples 283-290 | | | | | | | |
|---|---|---|---|---|---|---|---|---|---|
| | | 283 | 284 | 285 | 286 | 287 | 288 | 289 | 290 |
| Sodium metasilicate | | — | — | — | — | — | — | — | — |
| Sodium molybdate | | 3 | 3 | 3 | 3 | 5 | 5 | 5 | 5 |
| pH of surface treatment solution (20° C.) | | 10.0 | 10.0 | 10.0 | 10.0 | 10.5 | 10.5 | 10.5 | 10.5 |
| Properties | | | | | | | | | |
| Salt spray test | FC200 | X | X | X | X | X | X | X | X |
| (test base-material) | S45C | X | X | X | X | X | X | X | X |
| | SPCC | X | X | X | X | X | X | X | X |
| Adhesion of coating | FC200 | X | X | X | X | X | X | X | X |
| paint | S45C | X | X | X | X | X | X | X | X |
| (test base-material) | SPCC | X | X | X | X | X | X | X | X |

TABLE 81

| | | Comparative Examples 291-298 | | | | | | | |
|---|---|---|---|---|---|---|---|---|---|
| | | 291 | 292 | 293 | 294 | 295 | 296 | 297 | 298 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 40/0/120 | 90/0/60 | 40/0.5/60 | 150/4.5/30 |
| Concentration of surface treatment agent (%) | | | | | | | | | |
| Water | | 75 | 75 | 75 | 75 | 65 | 65 | 65 | 65 |
| Manganese dihydrogen phosphate | | 10 | 10 | 10 | 10 | 15 | 15 | 15 | 15 |
| Tetrasodium ethylenediamine tetraacetate | | 15 | 15 | 15 | 15 | 20 | 20 | 20 | 20 |
| Sodium metasilicate | | — | — | — | — | — | — | — | — |
| Sodium molybdate | | 10 | 10 | 10 | 10 | 15 | 15 | 15 | 15 |
| pH of surface treatment solution (20° C.) | | 9.5 | 9.5 | 9.5 | 9.5 | 9.5 | 9.5 | 9.5 | 9.5 |
| Properties | | | | | | | | | |
| Salt spray test | FC200 | X | X | X | X | Δ | Δ | Δ | ○ |
| (test base-material) | S45C | X | X | X | X | Δ | Δ | Δ | ○ |
| | SPCC | X | X | X | X | Δ | Δ | Δ | ○ |
| Adhesion of coating | FC200 | X | X | X | X | X | X | X | X |
| paint | S45C | X | X | X | X | X | X | X | X |
| (test base-material) | SPCC | X | X | X | X | X | X | X | X |

TABLE 82

| | | Comparative Examples 299-306 | | | | | | | |
|---|---|---|---|---|---|---|---|---|---|
| | | 299 | 300 | 301 | 302 | 303 | 304 | 305 | 306 |
| Condition of heating and pressing | | | | | | | | | |
| temperature/pressure/time (° C./kgf/cm$^2$/min) | | 30/0/60 | 30/0.2/30 | 30/0.2/60 | 200/12/0.5 | 30/0/60 | 30/0.2/30 | 30/0.2/60 | 200/12/0.5 |
| Concentration of surface treatment agent (%) | | | | | | | | | |
| Water | | 87 | 87 | 87 | 87 | 79 | 79 | 79 | 79 |
| Manganese dihydrogen phosphate | | 3 | 3 | 3 | 3 | 5 | 5 | 5 | 5 |
| Tetrasodium ethylenediamine tetraacetate | | 5 | 5 | 5 | 5 | 8 | 8 | 8 | 8 |
| Sodium metasilicate | | 5 | 5 | 5 | 5 | 8 | 8 | 8 | 8 |
| Sodium molybdate | | 3 | 3 | 3 | 3 | 5 | 5 | 5 | 5 |
| pH of surface treatment solution (20° C.) | | 11.0 | 11.0 | 11.0 | 11.0 | 11.2 | 11.2 | 11.2 | 11.2 |
| Properties | | | | | | | | | |
| Salt spray test | FC200 | X | X | X | X | X | X | X | X |
| (test base-material) | S45C | X | X | X | X | X | X | X | X |
| | SPCC | X | X | X | X | X | X | X | X |

TABLE 82-continued

| | | Comparative Examples 299-306 | | | | | | | |
|---|---|---|---|---|---|---|---|---|---|
| | | 299 | 300 | 301 | 302 | 303 | 304 | 305 | 306 |
| Adhesion of coating | FC200 | X | X | X | X | X | X | X | X |
| paint | S45C | X | X | X | X | X | X | X | X |
| (test base-material) | SPCC | X | X | X | X | X | X | X | X |

TABLE 83

| | | Comparative Examples 307-310 | | | |
|---|---|---|---|---|---|
| | | 307 | 308 | 309 | 310 |
| Condition of heating and pressing | | | | | |
| temperature/pressure/time (° C./kgf/cm$^2$/min) | | 30/0/60 | 30/0.2/30 | 30/0.2/60 | 200/12/0.5 |
| Concentration of surface treatment agent (%) | | | | | |
| Water | | 60 | 60 | 60 | 60 |
| Manganese dihydrogen phosphate | | 10 | 10 | 10 | 10 |
| Tetrasodium ethylenediamine tetraacetate | | 15 | 15 | 15 | 15 |
| Sodium metasilicate | | 15 | 15 | 15 | 15 |
| Sodium molybdate | | 10 | 10 | 10 | 10 |
| pH of surface treatment solution (20° C.) | | 11.5 | 11.5 | 11.5 | 11.5 |
| Properties | | | | | |
| Salt spray test | FC200 | X | X | X | X |
| (test base-material) | S45C | X | X | X | X |
| | SPCC | X | X | X | X |
| Adhesion of coating | FC200 | X | X | X | X |
| paint | S45C | X | X | X | X |
| (test base-material) | SPCC | X | X | X | X |

TABLE 84

| | Comparative Examples 311-318 | | | | | | | |
|---|---|---|---|---|---|---|---|---|
| | 311 | 312 | 313 | 314 | 315 | 316 | 317 | 318 |
| Condition of heating and pressing | | | | | | | | |
| temperature/pressure/time (° C./kgf/cm$^2$/min) | 150/4.5/30 | 150/4.5/30 | 150/4.5/30 | 150/4.5/30 | 150/4.5/30 | 150/4.5/30 | 150/4.5/30 | 150/4.5/30 |
| Concentration of surface treatment agent (%) | | | | | | | | |
| Water | 92 | 87 | 75 | 90 | 83 | 67 | 91 | 89 |
| Manganese dihydrogen phosphate | 3 | 5 | 10 | 3 | 5 | 10 | 3 | 3 |
| Tetrasodium ethylenediamine tetraacetate | 5 | 8 | 15 | 5 | 8 | 15 | 3 | 3 |
| Sodium metasilicate | — | — | — | 2 | 4 | 8 | | 2 |
| Sodium molybdate | — | — | — | — | — | — | 3 | 3 |
| pH of surface treatment solution (20° C.) | 5.0 | 5.0 | 5.0 | 8.0 | 8.0 | 8.0 | 6.0 | 7.0 |
| Change in dimension and surface profile of base-material) | | | | | | | | |
| FC200 | | | Nonuniform surface is found (rough surface) | | | | | |
| S45C | | | Nonuniform surface is found (rough surface) | | | | | |
| SPCC | | | Nonuniform surface is found (rough surface) | | | | | |

*Corrosion of surface is found in the non-surface-treated base materials of FC200, S45C and SPCC when they are allowed to staud at room temeperature for 1-3 hours From comparison between Examples 193-252 of TABLES 68-75 and Comparative Examples 251-318 of TABLES 76-84 it was found that Examples 193-252 were all acceptable in terms of the rust resisting time in the salt spray test which was 5 hours or more as well as adhesion of the paint. In contrast to this, Comparative Examples 251-310 were all rejected in terms of adhesion of the paint. Also, Comparative Examples 311-318 were less than 9 in pH of the surface treatment liquid, such that the change (reduction) of dimension resulting from the corrosion or the corrosion of surface was found.

Following facts were found from the salt spray test results of Comparative Examples.

Comparative Examples 251-253, 255-257, 259-261, 267-269, 271-273, 275-277, 283-285, 287-289, 291-293, 299-301, 303-305 and 307-309 were rejected. This is because the surface treatment conditions were not fulfilled in that the heating temperature was as low as 30° C. (less than 35° C.), the pressure was zero or 0.2 kgf/cm$^2$, etc. Comparative Examples 254, 258, 262, 270, 274, 278, 286, 290, 294, 302, 306 and 310 were rejected. This is because although the heating temperature was as high as 200° C. and also the pressure was as high as 12 kgf/cm$^2$, the processing time was as significantly short as 0.5 min. (less than one minute). Comparative Examples 263-266, 279-282 and 295-298 were evaluated to be acceptable in the salt spray test, despite of being rejected in terms of adhesion of the paint. This is probably because the surface treatment conditions were adequate.

On the other hand, comparative Examples 263-266, 279-282 and 295-298 were rejected in terms of adhesion of the paint, despite of being adequate in the surface treatment conditions. This was due to the concentration of components of the surface treatment liquid. In Comparative Examples 263-266, the manganese dihydrogen phosphate concentration was in excess of 10% and the ethylenediamine tetrasodium tetraacetate concentration was in excess of 15%. In Comparative Examples 279-282, the sodium metasilicate concentration was in excess of 15%, in addition to those concentrations. This probably caused the residual of the surface treatment liquid to adhere to the surface of the test pieces, resulting in the rejection. Comparative Examples 295-298, the manganese dihydrogen phosphate concentration was in excess of 10% and the ethylenediamine tetrasodium tetraacetate concentration was in excess of 15% and also 15% of sodium molybdate was added. This probably caused the residual of the surface treatment liquid to adhere to the surface of the test pieces, resulting in the rejection.

Examples using the aqueous solution to which no silicate or molybdenum compound was added (Examples 199-207) were all evaluated to fall under the category "Δ" in the salt spray test (the rust resisting time in the range of 5 hours or more to less than 24 hours). On the other hand, some of Examples using the aqueous solution to which silicate or molybdenum compound was added (Examples 208-252) were evaluated to fall under the category "○" in the salt spray test (the rust resisting time of 24 hours or more) under the conditions of heating under pressure: 150° C./4.5 kgf/30 minutes or 200° C./12 kgf/5 minutes. It can be said from this fact that the addition of silicate or molybdenum compound produced an improved rust resistance as a whole.

Although representative examples have been described above, the present invention can of course provide substantially the same results when applied to the other metals.

CAPABILITY OF EXPLOITATION IN INDUSTRY

As mentioned above, the present invention provides an effective surface treatment method of a metal member, alternative to the pre-cleaning process and the base coat process, for stably producing a good surface treatment coating at a lower cost without inducing ill effects in the human body as well as without any possible dimensional change and non-uniform surface resulting from corrosion, irrespective of the kinds of metal member. Accordingly, the surface treatment method of the present invention is suitable for the surface treatment of the metal members having a variety of sizes and shapes, including vehicle bodies and cases of mobile phones.

Also, the metal product of the present invention has a surface treatment coating or a composite corrosion-resistant coating that can provide substantially no dimensional change resulting from the corrosion and has excellent corrosion resistance. Accordingly, the metal produce of the present invention is suitable for applications for which high dimensional accuracy and corrosion resistance are required.

The disclosure of the priority document, Japanese Application No. 2001-355492, filed Nov. 21, 2001, is incorporated by reference herein in its entirety.

What is claimed is:

1. A method of surface-treating a metal member, the method comprising heating the metal member to a temperature of 150° C. or more at a pressure in a range of 4.5 to 12 kgf/cm$^2$ for a period of one minute or more in an aqueous alkaline solution having a pH of 9 or more and comprising a manganese compound and a chelating agent for complexing the manganese compound dissolved in water.

2. The method according to claim 1, wherein the metal member contains at least one material selected from the group consisting of magnesium, magnesium alloy, aluminum, aluminum alloy, iron, iron alloy, copper, copper alloy, zinc, zinc alloy, tin, and tin alloy.

3. The method according to claim 1, wherein the aqueous alkaline solution further comprises, dissolved in the water, at least one of a silicate and a molybdenum compound.

4. Metal goods comprising a metal member containing at least one material selected from the group consisting of magnesium, magnesium alloy, aluminum, aluminum alloy, iron, iron alloy, copper, copper alloy, zinc, zinc alloy, tin, and tin alloy; and a surface treatment coating on the metal member, wherein the surface treatment coating is produced by a process comprising heating the metal member to a temperature of 150° C. or more at a pressure in a range of 4.5 to 12 kgf/cm$^2$ for a period of one minute or more in an aqueous alkaline solution having a pH of 9 or more and comprising a manganese compound and a chelating agent for complexing the manganese compound dissolved in water.

5. The metal goods according to claim 4, wherein the alkaline solution further comprises, dissolved in the water, at least one of a silicate and a molybdenum compound.

6. The metal goods according to claim 4, further comprising a paint on the surface treatment coating.

7. The metal goods according to claim 6, wherein the paint is produced by a process comprising applying to the surface treatment coating a resin dissolved in an organic solvent or water; and curing the applied resin.

8. The metal goods according to claim 5, further comprising a paint on the surface treatment coating.

9. The metal goods according to claim 8, wherein the paint is produced by a process comprising applying to the surface treatment coating a resin dissolved in an organic solvent or water; and curing the applied resin.

10. The metal goods according to claim 4, wherein the metal member comprises a magnesium alloy.

11. A method of making metal goods, the method comprising heating a metal member in an aqueous alkaline solution having a pH of 9 or more and comprising a manganese compound and a chelating agent dissolved in water; and producing the metal goods of claim 4.

12. The method according to claim 1, wherein the metal member is heated in the aqueous alkaline solution under pressure in a range of from 4.5 $kgf/cm^2$ to 12 $kgf/cm^2$ for a period in a range of from 5 minutes to 30 minutes.

13. The method according to claim 3, wherein the metal member is heated in the aqueous alkaline solution under pressure in a range of from 4.5 $kgf/cm^2$ to 12 $kgf/cm^2$ for a period in a range of from 5 minutes to 30 minutes.

14. The metal goods according to claim 4, wherein the metal member is heated in the aqueous alkaline solution under pressure in a range of from 4.5 $kgf/cm^2$ to 12 $kgf/cm^2$ for a period in a range of from 5 minutes to 30 minutes.

15. The metal goods according to claim 5, wherein the metal member is heated in the aqueous alkaline solution under pressure in a range of from 4.5 $kgf/cm^2$ to 12 $kgf/cm^2$ for a period in a range of from 5 minutes to 30 minutes.

* * * * *